US005957225A

United States Patent [19]

Sinor

[11] Patent Number: 5,957,225

[45] Date of Patent: Sep. 28, 1999

[54] DRILLING ASSEMBLY AND METHOD OF DRILLING FOR UNSTABLE AND DEPLETED FORMATIONS

[75] Inventor: Lawrence Allen Sinor, Tulsa, Okla.

[73] Assignee: BP Amoco Corporation, Chicago, Ill.

[21] Appl. No.: 08/904,027

[22] Filed: Jul. 31, 1997

[51] Int. Cl.[6] ..... E21B 7/20

[52] U.S. Cl. ..... 175/57; 175/171; 175/257

[58] Field of Search ..... 175/57, 171, 257, 175/314, 320

[56] References Cited

U.S. PATENT DOCUMENTS

| | | | |
|---|---|---|---|
| 2,205,119 | 6/1940 | Hall et al. | 166/278 |
| 5,234,055 | 8/1993 | Cornette | 166/278 |
| 5,845,722 | 12/1998 | Makohl et al. | 175/171 |

*Primary Examiner*—David Bagnell
*Assistant Examiner*—Chi H. Kang
*Attorney, Agent, or Firm*—James A. Gabala; Robert E. Sloat

[57] ABSTRACT

A method and liner assembly for drilling into unstable or depleted formations is provided that maintains control of the wellbore against caving such as where unconsolidated formations are penetrated and/or minimizes fluid losses such as to underpressured formations where differential pressures exist. The method and liner assembly herein includes the provision of a liner having a portion thereof that is drillable so that after setting of the liner, drilling can continue deeper into the unstable formations with minimal damage to the bit used to drill out the liner drillable portion. In one form, the liner has a shoe that includes cutter mounting blades, each having a set of cutters thereon. Relief slots are formed in the blades between cutters so that as the shoe and its blades are being drilled, the drill bit will cut through the slots, releasing the shoe cutters for transport up to the surface by the drilling fluid thereby minimizing damaging contact of the bit with the shoe cutters. Preferably, the shoe has a bi-center and anti-whirl design. In another form, the liner has preassembled therewith a whipstock and a pre-formed window of drillable material adjacent the whipstock, so that after drilling into the unstable formation with the liner assembly and setting it therein, subsequent drilling beyond the liner occurs by running a drill bit downhole and drilling until it engages the whipstock that guides it to the window for drilling therethrough.

21 Claims, 12 Drawing Sheets

DRILLING ASSEMBLY AND METHOD OF DRILLING FOR UNSTABLE AND DEPLETED FORMATIONS

FIELD OF THE INVENTION

The invention relates to drilling methods and liner assemblies therefor, and more particularly, to drilling methods and liner assemblies for drilling into unstable or depleted formations.

BACKGROUND OF THE INVENTION

In typical oil and/or gas rotary drilling operations, a turntable on the floor of a drilling rig rotates a string of hollow steel drill pipes at the bottom of which is a rotary drill bit. The bit grinds the rock as it is rotated by the drill pipe. A drilling fluid is pumped clown through the drill pipe that flushes out the rock cuttings from the bit face and lubricates the bit and then returns up the annular space between the drill string and the sidewalls of the bore being drilled. The drilling fluid or mud cools and lubricates the bit, carries the drill cuttings from the hole to the surface and cakes the wall of the hole to prevent caving before steel casing is set. The hydrostatic pressure exerted by the column of mud in the hole prevents blowouts that may result when the bit penetrates a high pressure oil or gas zone. Thus the weight in pounds per gallon (ppg) of the drilling fluid must be sufficiently high to prevent blowouts, but not high enough to enter into formation rocks such as where unconsolidated sections exist or by causing fracturing of the formation. In other words, if the mud pressure is too low, the formation fluid can force the mud from the hole, resulting in a blowout, whereas if the mud pressure becomes too high, the differential pressure becomes great enough that mud flows into the formation and/or the rock adjacent to the well may be fractured, resulting in lost circulation. Herein, lost circulation or lost returns is defined as the loss to formation voids of the drilling fluids used in rotary drilling. This loss may vary from a gradual lowering of the mud level in the pits to a complete loss of returns. The loss of drilling mud and cuttings into the formation results in slower drilling rates and plugging of productive formations. When circulation suddenly diminishes, the drilling rate or rate of penetration (ROP) must be scaled back as the mud flow rate is reduced. Moreover, losing mud into productive formations can severely damage the formation permeability, lowering production rates therefrom. Such plugged formations must often be subjected to costly enhanced recovery techniques in an effort to restore the formation permeability to raise production rates back up to their former levels. In addition to slower drilling and lowered production rates, Is the chemicals used in drilling mud can be fairly expensive, the loss of the drilling mud itself to the formation is also economically undesirable.

Optimizing the drilling fluid hydraulics for proper flow and circulation where the mud sweeps the bottom-hole surface free of cuttings, entrains the bit cuttings and carries them to the surface is important for drilling efficiency reducing rig down time for tripping to replace prematurely worn drill bits. In this regard, it is important to consider both the design of the bit and the various sources of pressure or energy losses within the circulatory systems. More particularly, the return velocity of the mud in the annular space between the drill pipe and bore hole walls must be maintained at a rate sufficient to extract the bit cuttings and carry them up to the surface despite the frictional losses encountered in the annular space. The pressure or head losses in the drilling fluid in the annulus between the drill pipe and bore is generally low due to the relatively large size of the annular space that maintains substantially laminar flow of mud therethrough because of the difference in diameters between the larger diameter of the hole or bit size in comparison to the smaller diameter drill pipe. In any event, the frictional losses on the circulating mud system should be considered for determining the fluid pressure requirements at the pump to obtain desired mud flow rates and return velocities. If the drilling fluid pressure at the bottom of the bore hole is too high, it impedes the drilling action of the bit. Rock failure strength increases, and the failure becomes more ductile as the pressure acting on the rock is increased. Ideally, cuttings are cleaned from beneath the bit by the drilling fluid stream. However, relatively low differential mud pressure tends to hold cuttings in place. In this case, mechanical action of the bit is often necessary to dislodge the chips. Regrinding of the fractured rock can greatly decrease drilling efficiency by lowering the drilling rate and increasing bit wear. In extreme conditions, the rock can be ground to a fine dust that can agglomerate and re-cement onto the bit preventing effective cutting. Such recementing is termed "balling."

The drill string usually consists of 30-foot lengths of relatively small diameter drill pipe (e.g. 5 in. O.D.) coupled together. On the lower end are heavier-walled lengths of pipe, called drill collars, that help regulate weight on the bit. When the bit has penetrated the distance of a pipe section, drilling is stopped, the string is pulled up to expose the top joint, a new section added, the string lowered and drilling resumed. The process continues until the bit becomes worn out, at which time the entire drill string must be pulled. Pipe is usually disconnected in triples or 90-foot sections of pipe, and stacked in the derrick. The process continues until the bit reaches the surface. A new bit is attached, and the drilling string reassembled and lowered into the hole. Such round trips may take up to two-thirds of total rig operating time, depending on the depth of the hole. It is desirable to increase both bit life and drilling rates simultaneously to minimize drilling time. Where the bit has high wear rates requiring increased number of trips into and out of the wellbore, or where complex lithologies exist such as requiring drilling through an unstable or depleted formation with attendant well bore stability and/or loss of circulation problems, the rig time can become very expensive in relation to the anticipated production from the well.

Thus, drilling costs depend on the cost of such items as the drilling rig, the bits, and the drilling fluid, as well as on the drilling rate, the time required for tripping to replace a worn bit, and bit life. The cost-per-foot generally increases with depth when encountering geopressures, heavy shale, lost circulation, and well consolidated hard formations such as hard limestone stringers.

Normally, once a wellbore has been drilled, it is lined or cased with heavy steel piping, and the annulus between the wellbore and casing is filled with cement. Properly designed and cemented casing prevents collapse of the wellbore and protects fresh water aquifers above the oil and gas reservoir from becoming contaminated with oil and gas and the oil reservoir brine. Similarly, the oil and gas reservoir is prevented from becoming invaded by extraneous water from aquifers that penetrated above the productive reservoirs. The total length of casing of uniform outside diameter that is run in the well during a single operation is called a casing string. The casing string is made up of joints of steel pipe that are screwed together to form a continuous string as the casing is extended into the wellbore. There are three principal types of casing strings, the classification being based on the primary function of the string. The surface string protects the fresh water sand. In deep wells, one or more intermediate strings of casing are set in order to cement off either high pressure intervals that cannot be controlled by the weight of the drilling fluid, or low pressure intervals into which large volumes of drilling mud may flow and result in lost circulation, preventing further controlled drilling, as previously described. The oil or production string is the member through which the well is completed, produced, and controlled. The casing size should be of a relatively large diameter where it is anticipated that multizone completions are a possibility, workovers will be necessary, or drilling conditions will necessitate one or more intermediate strings. However, large diameter holes and casings increase the costs associated with the drilling and completion of a wellbore.

As discussed above, the casing, together with the cement, performs the following functions, namely to (1) prevent caving of the hole, (2) prevent contamination of fresh water in the upper sands, (3)exclude water from the producing formation, (4) confine production to the wellbore, (5) provide means for controlling pressure, and (6) facilitate installation of any anticipated subsurface equipment that may be necessary. In selecting casing, the engineer must consider the forces to which the casing will be subjected including external pressure, internal pressure, and a longitudinal or axial loading on the casing. External pressure, such as caused by differential pressures between adjacent formations, tends to collapse the casing, and internal pressure tends to burst the casing. Axial loading may be tension due to dead weight or compression due to buoyancy. Axial tension has two pronounced effects: it tends to pull the casing apart, and it lowers the resistance of the casing to collapse from external pressures. In addition, as the individual lengths of casing are usually joined by means of threaded couplings, it is important that they have sufficient strength to resist rupture or deformation under the axial stresses to which they will be subjected. Also, they must be leak-resistant in tension if the casing string is to perform its functions properly.

A liner is an abbreviated oil casing string that generally extends from the bottom of the hole upward to a point approximately 300 feet above the lower end of the protection string, where it is suspended from a liner hanger and sealed off. Its function is similar to that of an oil casing string such that it must have similar physical characteristics. Its obvious advantage over a conventional string that would extend from the bottom of the hole to the surface is economy, since less pipe is needed for a liner. Similar to casings, when selecting a liner, it is important to consider the external and internal pressure and axial loading forces it must withstand.

As previously mentioned, drilling challenges occur due to formation lithology where drilling must proceed through unstable or depleted formations such as through low pressure reservoirs, such as around old producers, or through unconsolidated reservoirs, such as salt domes that create wellbore stability problems. Typical drilling methods in dealing with these situations include drilling with drill string to within a few meters of the unstable or depleted reservoir, tripping the drill string out of the hole and running casing to bottom and setting it in cement in an effort to isolate as much of the overburden as possible so as to minimize the negative effects of lost returns. Nevertheless, once the remainder of the overlying reservoir is drilled and the unstable or depleted reservoir is penetrated, the differential pressure will still cause the weighted mud system to be influxed into the low pressure formation that plugs up the formation. Another method is to drill until the bottom of the hole "falls out", remove the drill pipe from the hole, and seal off the losses with a so-called "gunk pill" or cement plug. Casing is then run into the bore to the top of the loss zone where the reservoir is drilled with a reduced mud weight to prevent further losses. Neither of these methods is satisfactory due to the time required for pulling the drill pipe and the losses of the weighted mud, gunk squeezes, and cement to the production zone.

Based on the above, it is apparent that there are a number of significant engineering decisions that must be made when designing a wellbore drilling and completion program in an effort to maximize returns from a particular well. These decisions can be critical, especially where rig time is very expensive, e.g., offshore drilling, and where complex lithologies exist. It is always important to minimize the time required to properly drill and complete a wellbore so that profitable production can begin with no undue delays. One area that is constantly under scrutiny is the time it takes to trip in and out of the wellbore and how often this occurs for a given amount of depth that is drilled. Accordingly, one method of drilling that has been proposed is to use the casing as drill pipes to drill the bore hole to save rig time for running casing into the hole after drilling. However, applicants have found that the use of a casing for drilling is not without problems primarily due to the larger size of casing with respect to the drill string that creates a smaller sized annulus. These problems range from tight hole or stuck pipe concerns to the proper drill bit selection and design and ensuring good fluid hydraulics for the mud. Moreover, casing is not normally subjected to torquing forces like a drill pipe, so that where the casing is rotated for rotating the bit, the torque forces on the casing can create problems that normally are not considered.

Where the hole has to be enlarged for fitting large diameter piping into the hole, the use of expandable underreamers are known to allow the bit to be run through a hole having a smaller diameter than it will cut. Typically, once drilling with the underreamer bit is completed, the arms of the reamer are collapsed and it is retrieved from the bore and the casing is set in cement. With the underreamer pulled from the bore, drilling can continue beyond the casing if necessary to extend the bore deeper into additional underlying producing formations. However, the additional time required to pull the bit for subsequent drilling beyond the liner is undesirable.

Another bit known for making enlarged holes is a bi-center bit where sets of cutters are mounted eccentrically with respect to the central axis of the bit. However, normal bi-center bits have been found to be unstable and more readily undergo harmful bit vibration when rotated with their asymmetric design, and accordingly, their use is not favored as it is difficult to control the bore being drilled and the cutters thereon tend to break from the bit. In addition, using bi-centers rigidly fixed on casings is not done. One problem with this is that fixed bits can not be pulled back through the casing once drilling is complete, thus rendering subsequent drilling beyond the casing bottom more difficult. Accordingly, there is a need for a cost-effective method and drilling assembly that allows unstable or depleted formations to be drilled and controlled against wellbore stability problems and fluid loss to the formation. Further, there is a need for an improved drilling method and assembly that allows for the use of a casing or liner pipe such as in drilling into unstable or depleted formations that minimizes pipe hang-up problems and provides for satisfactory fluid hydraulics.

SUMMARY OF THE INVENTION

In accordance with the present invention, a method of drilling and a drilling assembly for unstable or depleted formations is provided that allows unstable or depleted formations to be drilled in a timely and cost-effective manner, while also avoiding wellbore control and fluid loss problems normally associated with conventional drilling when encountering such unstable or depleted formations. The present invention utilizes a liner assembly for drilling into the unstable or depleted formation with the liner having a portion thereof that is formed of a drillable material so that after the liner assembly has been set, the liner portion of drillable material can be subsequently drilled for extending the wellbore deeper into or beyond the unstable or depleted formation. By setting the liner assembly when drilling into the unstable or depleted formation, well control problems are minimized such as seen with collapsed bore walls where the unstable or depleted formation is unconsolidated or with fluid losses and plugging of the productive zone in an underpressured formation clue to differential pressure while drilling therein from an overlying overburden. In addition, setting the liner right after drilling without requiring removal of the drill pipe, or the cutters, presents a significant savings in terms of the time required for pulling drill pipe and thereafter running the casing or liner into the hole as is normally done. Also, where fluid losses are a concern, during this time the pressure in the wellbore must be maintained to control the overburden so that fluid losses to the unstable or depleted or underpressured formation will normally continue to mount while the drill pipe is pulled and the casing is run.

By providing the liner with a portion that is drillable, there is no need to pull the cutters from the hole such as commonly done with underreamers, as previously described, as when additional drilling is desired, the additional drilling can occur through the drillable portion of the liner. In addition, the wear on the drill bit is reduced by providing a portion in the liner that is made from a drillable material, thus providing better drilling rates and a longer bit life for the drill bit used to penetrate the formations beyond the liner assembly.

In one form of the present invention, a method of drilling into a reservoir formation that is unstable or depleted relative to adjacent formations is provided. The method includes drilling into an area above the unstable or depleted formation to form a wellbore in the area. An elongate liner assembly is provided having a portion thereof formed of a drillable material and cutters are provided carried by the liner assembly disposed adjacent the bottom of the liner assembly. The liner assembly is run into the wellbore and the cutters are rotated to drill through the area above the unstable or depleted formation and into an area in the unstable or depleted formation to extend the wellbore into the unstable or depleted formation with at least a section of the liner assembly in the unstable or depleted formation. The liner assembly is set in the wellbore to secure the assembly therein with the cutter staying in the bore. A drill bit can then be run into the wellbore and rotated to cut through the liner portion of drillable material for drilling beyond the set liner assembly. As mentioned earlier, the present method is a substantial improvement over prior methods where cutters had to be pulled from the bore through the casing used as drill pipe or where the entire set liner had to be drilled out before the bore could be extended beyond the liner assembly. The present method is a much more efficient way of performing controlled drilling through unstable or depleted formations while still allowing for subsequent drilling operations deeper into the unstable or depleted formation and/or the formations therebelow.

In one form, the drillable liner portion can be a shoe of drillable material on the bottom of the liner assembly and having cutters thereon. The method can further include providing mounting portions on the shoe for the cutters with the mounting portion including relief slots formed therein wherein the mounting portions are of a material that can be cut by the rotary drill bit. The cutters are released from the mounting portion by cutting through the shoe mounting portions and reliefs therein with the drill bit so as to minimize damaging contact of the drill bit with the cutters. In this manner, the life of the drill bit utilized to drill through the shoe mounting portion is extended so as to improve drilling performance with the drill bit. The cutters on the liner shoe can be rotated by rotating the liner assembly to perform rotary drilling operations therewith.

In another form, the drillable liner portion can be a window of material formed in the liner assembly that can be cut by the rotary drill bit. The method includes providing a whipstock deflection plate that is secured in the liner assembly adjacent the window and cutting through the window for drilling beyond the set liner assembly by engaging the rotating drill bit with the deflection plate and guiding the rotating drill bit to the window with the deflection plate where the bit cuts through the window to the formation exterior of the liner assembly. Prior methods utilizing whipstocks typically required running the whipstock downhole independent of any casing already in the bore and then running the drill pipe and bit thereon until it engaged the whipstock plate to guide it into the desired direction. As is apparent, the present method is a much more timely process where the whipstock deflection plate is already provided in place in the liner assembly; and, further, since the liner assembly is used to drill, it takes the whipstock downhole therewith as drilling progresses, and by providing the liner with a window of drillable material, subsequent cutting therethrough is facilitated.

The liner assembly can be filled with drillable material around the whipstock deflection plate, and the cutters carried by the liner assembly can be on a liner drill bit that is rotated by rotating the liner assembly to perform rotary drilling operations therewith. Filling the liner assembly with a drillable material, such as concrete or plastic, is of particular importance where a window of drillable material has been formed in the liner wall and the liner is rotated for drilling to ensure that the liner body will not yield or twist off when drilling down.

Where the unstable or depleted formation has a lower formation pressure relative to formations thereabove, the method can include circulating drilling fluid through the wellbore during drilling into the area in the overlying formations above the low-pressure formation with the drilling fluid having a first fluid weight sufficient to control fluid flow from the overlying formation. The fluid weight can be adjusted to a weight sufficiently lower than the first fluid weight before drilling with the drill bit to control fluid flow from the low-pressure formation and to minimize drilling fluid losses to the low-pressure formation. With the method of the present invention, the loss of fluids to unstable or depleted, low-pressure formations can be better controlled so as to minimize the expense associated with lower drilling rates and plugged-up producing zones. The fluid weight can be adjusted to the lower weight during the rotating of the cutters as they are drilling through the overlying formation and entering the low-pressure formation.

Where the unstable or depleted formation is a low-pressure formation so that there is a differential between the overburden and low-pressure formation, it is preferred that the overlying formation be sealed from the low-pressure formation after running of the liner assembly and rotating of the cutters to limit formation or wellbore damage due to the differential pressure encountered when drilling from the overlying formation into the low-pressure formation.

In another form of the invention, a liner assembly for drilling into an unstable or depleted formation is provided having a substantially elongate annular body with cutters carried on the body at the bottom thereof. A cutter-rotating mechanism is provided for rotating the cutters to drill a wellbore into the unstable or depleted formation so that at least a section of the elongate body is disposed in the unstable or depleted formation after drilling with the cutters. A drillable portion of the liner assembly is provided for being drilled out after the body is set in the wellbore with the section of the body set in the unstable or depleted formation. As previously discussed, the liner assembly having the drillable portion for being drilled after setting of the liner assembly provides for improved results when drilling beyond the liner assembly. The cutter rotating mechanism can include a rotary drill string connected to the top of the elongate body to transmit rotation from the string to the elongate body for rotating the body and the cutters at the bottom thereof.

In one form, the elongate body includes a liner portion and a shoe portion attached to the liner portion at the bottom thereof with the shoe having a cutter mounting portion thereof on which the cutters are mounted. The liner drillable portion includes the shoe cutter mounting portion that is of a drillable material. Relief spaces are formed in the cutter-mounting portion so that when the material of the drillable cutter-mounting portion is being drilled out by a drill bit, the cutters will release as the drill bit cuts through the mounting portion and reaches the reliefs to minimize damaging contact of the drill bit with the cutters.

The shoe can have a bottom face with an outer periphery having a predetermined diameter. The cutter mounting portion can include first and second radial blades attached on the shoe bottom face extending generally radially outward toward the face outer periphery from inward locations on the face that are spaced from each other. Gauge cutters are on the blades slightly beyond the shoe face periphery to form the bore in the unstable or depleted formation having a diameter greater than the shoe face predetermined diameter.

The cutters can be mounted on the blades at predetermined positions along the radial blades with the predetermined positions selected so that resultant forces from the cutting action of the cutters are directed toward a predetermined location along the periphery of the shoe to minimize shoe vibrations and stabilize the shoe during cutting.

In another form, the shoe face has drilling fluid openings therein to allow drilling fluid to be circulated to the cutters and the blades have a predetermined thickness across the blades and a predetermined height from the shoe face with the number, size and location of the drilling fluid openings in the shoe face and the predetermined width and height of the blades being selected to optimize the rigidity and strength of the mounted cutters and the hydraulic flow of the circulating fluid to minimize pressure drops in the drilling fluid and balling of cut materials on the shoe. In this manner, the shoe cutter of the present invention cuts in a stable fashion without damaging balling occurring on the shoe.

In another form of the invention, the elongate annular body includes a liner portion having an annular wall defining a liner interior with the liner or drillable portion being a window of material in the annular wall that is of a lower hardness than the remainder of the wall for being drilled out by a drill bit. A whipstock deflection plate is secured in the liner interior adjacent the window so that as the drill bit is rotated and engages the plate, the bit will be guided to the window by the plate to cut through the window of lower hardness material for drilling into the formation exterior of the liner annular wall. In this form, the subsequent drilling avoids the bottom of the liner so that cutters therein need not be accounted for when drilling beyond the liner as, instead, the whipstock causes the drilling to kick out of the liner through the window.

In another form of the invention, a liner assembly for drilling into unstable or depleted formations is provided having a liner portion of the assembly, including a substantially annular wall of a first predetermined diameter and having a central longitudinal axis. A rotary shoe portion of the liner assembly is carried by the liner portion at the bottom of the annular wall. Sets of cutting elements are mounted to the shoe portion with a first set of cutting elements and a second set of cutting elements extending generally radially outward along the shoe. The first and second sets of cutting elements include respective inner cutters mounted at a radially innermost position relative to the other cutters in the set and outer cutters mounted at a radially outermost position relative to the other cutters in the set. The innermost cutters of the first and second cutter sets are spaced from each other on generally opposite sides of the longitudinal axis and the outermost cutters are mounted at positions beyond the liner wall predetermined diameter. A shoe rotating mechanism is provided for rotating the shoe and cutters carried thereon wherein rotation of the shoe and cutters drill a bore into the unstable or depleted formation having a second predetermined diameter greater than the first predetermined diameter so that as the shoe advances downhole cutting the bore, the liner carrying the shoe will move into the larger diameter bore to be disposed adjacent sidewalls of the bore so as to minimize bore damage as the shoe drills into the unstable or depleted formation. Thus, the above shoe having first and second sets of cutting elements has a bi-center design that will generally provide the liner with enough clearance to advance down the bore hole as it is being drilled.

In one form, the shoe has a periphery having a third predetermined diameter that is greater than the first predetermined diameter with the outermost cutters being mounted substantially at the shoe periphery at the first predetermined diameter so that the second and third predetermined diameters are substantially equal. In other words, the cutters are mounted so that they do not extend beyond the diameter of the face of the shoe that itself is lightly larger in diameter than the diameter of the liner wall.

In another form, the outermost cutters of at least one of the first and second sets of cutting elements are mounted slightly beyond the face periphery so that the third predetermined diameter is less than the second predetermined diameter. In this case, the outermost cutters of one of the sets are mounted beyond the shoe periphery and they will pass down an opening that is smaller than the bore that they will cut.

In one form, the first set of cutting elements has a first predetermined number of cutters and the second set of cutting elements has a second predetermined number of cutters less than the first predetermined number of the first set. Thus, the present drill shoe preferably has an asymmetrical design with an asymmetrical number of cutters on either side thereof that has been found to provide for more stable rotation of the shoe during drilling operations.

Bearing cutters or pads can be circumferentially spaced around the shoe from the first and second sets of cutting elements for riding along the bore sidewall as the shoe is rotated for drilling into the unstable or depleted formation.

In a preferred form of the invention, a rotary liner assembly is provided for drilling a bore hole into unstable or depleted formations. The rotary liner assembly includes a substantially annular liner having a longitudinal axis for being rotated in the bore hole about its longitudinal axis. A shoe is provided and includes cutter mounting blades at the leading end of the liner aligned along the liner longitudinal axis for rotating therewith. Cutting elements are mounted on the blades for engaging the formation and cutting therein as the liner and shoe are rotated. Reliefs in the blades are provided for drilling of the blade arms by a drill bit after the rotary liner assembly has drilled into the unstable or depleted formation and at least a section of the liner is set therein. To advance the bore hole beyond the liner, the drill bit cuts into the blade relief to release the cutting elements from their blade arms to minimize damaging contact of the drill bit with the cutting elements.

The blades include first and second blades that extend generally radially on the shoe and include respective first and second sets of cutting elements thereon with the radially inner ends of the blades being spaced from the longitudinal axis to rotate eccentrically relative to the rotation of the liner and shoe about the longitudinal axis to provide the shoe with a bi-center cutting arrangement.

As previously mentioned, the cutting elements can be mounted at predetermined positions and orientations relative to longitudinal axis with the predetermined positions and orientations being selected so that resultant forces from the cutting action of the cutting elements are directed towards a predetermined location on the shoe to minimize shoe vibrations and stabilize the shoe during cutting so that the shoe is prevented from "whirling" while it drills downhole and thus has an anti-whirl design.

In yet another form, a rotary liner assembly for drilling a bore into an unstable or depleted formation is provided and includes a substantially annular liner wall having predetermined outer and inner diameters and a central longitudinal axis extending therethrough. A retrievable bit body is carried at the bottom of the liner wall and has a shank portion and a cutter carrying portion with the cutter carrying portion having an annular section of a first predetermined diameter slightly less than the liner wall inner diameter. Primary cutters are mounted on the cutter support annular section for cutting the bore as the liner wall is rotated to substantially the first predetermined diameter. Gauge cutters are rigidly mounted to the bottom of the liner wall beyond the outer diameter thereof coaxially about the retrievable bit annular section for cutting the bore as the liner wall is rotated to a second predetermined diameter larger than the first diameter and wall outer diameter to form an annular space between the liner wall and the bore sidewall so that as the cutters advance downhole cutting the bore, the liner wall will move into the larger diameter bore to be disposed adjacent sidewalls of the bore so as to minimize bore damage as the cutters drill into the unstable or depleted formation. A passageway in the bit body directs drilling fluid in the liner through the passageway and to the primary cutters and up into the annular space past the gauge cutters. Entry ports in the shank allow drilling fluid in the liner to flow into the passageway, and seals around the bit body annular section prevent drilling fluid from flowing between the annular section and the interior of the liner annular wall so as to maintain drilling fluid flow through the entry ports and passageway and to the primary cutters.

The annular wall included a landing shoulder at the bottom thereof that releasably supports the bit body thereon. The bit body shank can include flange sections above the entry ports that can be gripped by a spear wireline retrieving tool to allow the bit body to be released from the landing shoulder and pulled from the bore with the spear tool to allow for drilling operations beyond the liner.

DETAILED DESCRIPTION OF THE PREFERRED EMBODIMENT

Figure 1A:
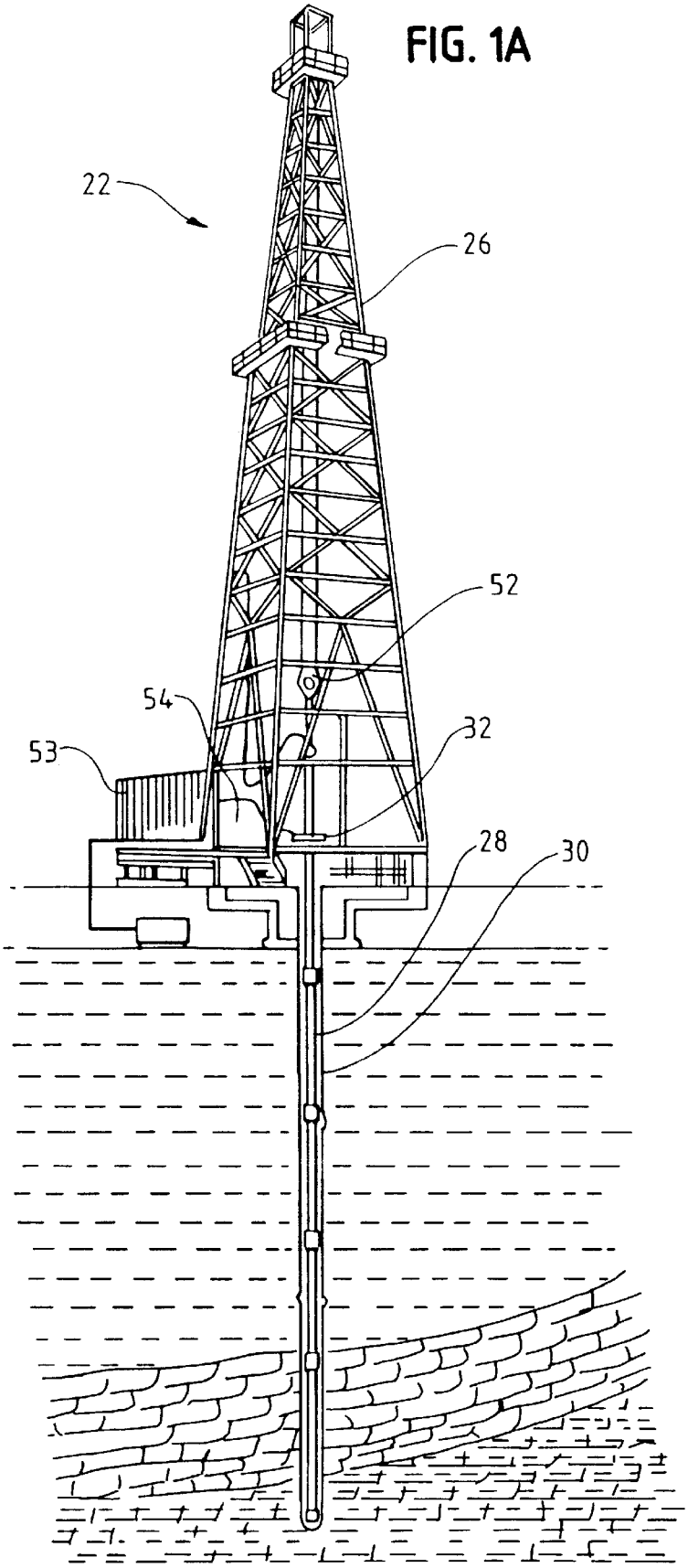
FIG. 1A is a perspective view of a drilling rig that is in the process of drilling a wellbore towards an unstable or depleted formation.

The present invention is to a method and a drilling assembly 10 that is particularly adapted for use in drilling into unstable or depleted formations, such as the illustrated chalk/limestone formation 12 (Tor) having a shale (Lista) overburden formation 14 directly thereabove, as shown in FIGS. 2–5. In this instance, the unstable or depleted formation is due to depletion from the Tor chalk formation (6.4 to 7.8 ppg mud weight) immediately below the overpressured, and unstable or depleted, Lista shale (14.7 ppg mud weight). As will be apparent to those skilled in the art, the present invention will find utility in a wide variety of drilling environments. It has particular utility where drilling operations begin to look for additional reserves below depleted sands that cause differential sticking problems, below salt domes containing shear zones that experience flow and wellbore stability problems, and in reservoirs with weak matrix strength where there is significant depletion around old producers. The method and drilling assembly 10 herein is well adapted to minimize wellbore control problems such as caused by caving and/or differential pressures as the drilling assembly 10 utilizes a casing or liner string 16 as the drilling pipe with the liner 16 having a rock cutting device 18 carried at the bottom or leading end thereof. In this manner, there is no drill pipe to be pulled once the unstable or depleted formation 12 is encountered so as to minimize the time that the potentially damaging effects of drilling into the unstable or depleted formation 12 can have on the wellbore stability and fluid circulation, as will be more particularly described herein. In addition, the method and drilling assembly 10 herein contemplate providing the liner 16 with a drillable portion, generally designated at 20, so that with at least a section 16*a* of the liner 16 set in the unstable or depleted formation 12 to prevent collapse of the wellbore walls 24*a* and, if necessary, to isolate the overburden 14 from the unstable or depleted formation 12, the drilling can be advanced beyond the set liner drilling assembly 10 by drilling through its drillable portion 20 while minimizing damage to the bit used to drill beyond the set liner 16.

Figure 1B:
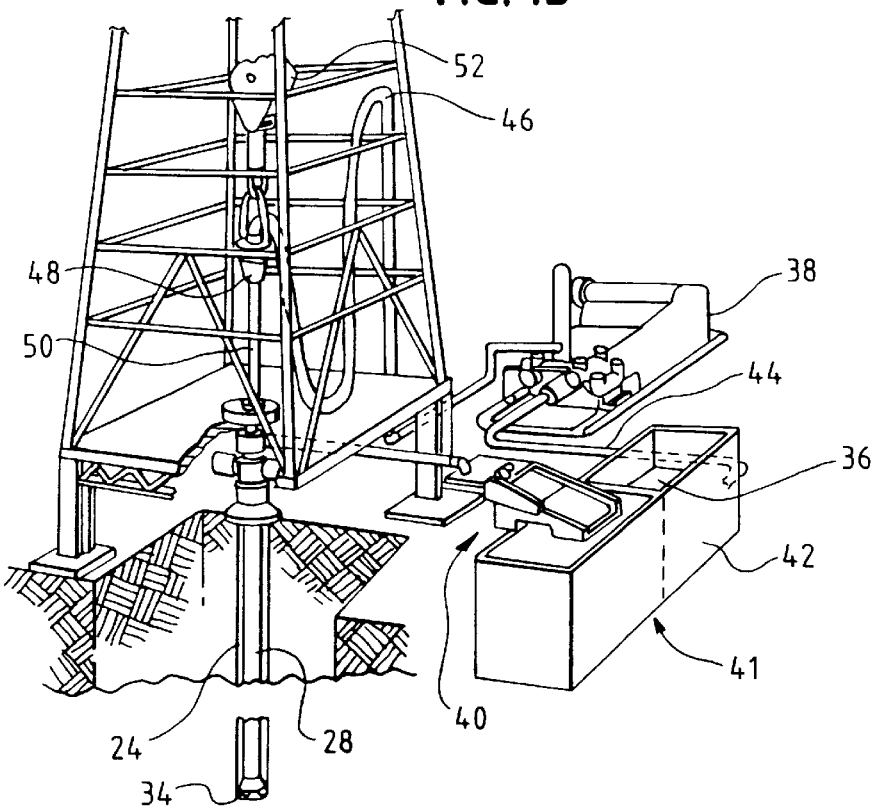
FIG. 1B is an enlarged view of a section of the rig of FIG. 1A showing the mud circulation system and the drill pipe extending from the rig down into the formation and having a conventional rotary tri-cone drill bit for grinding formation rock.
Figure 3:
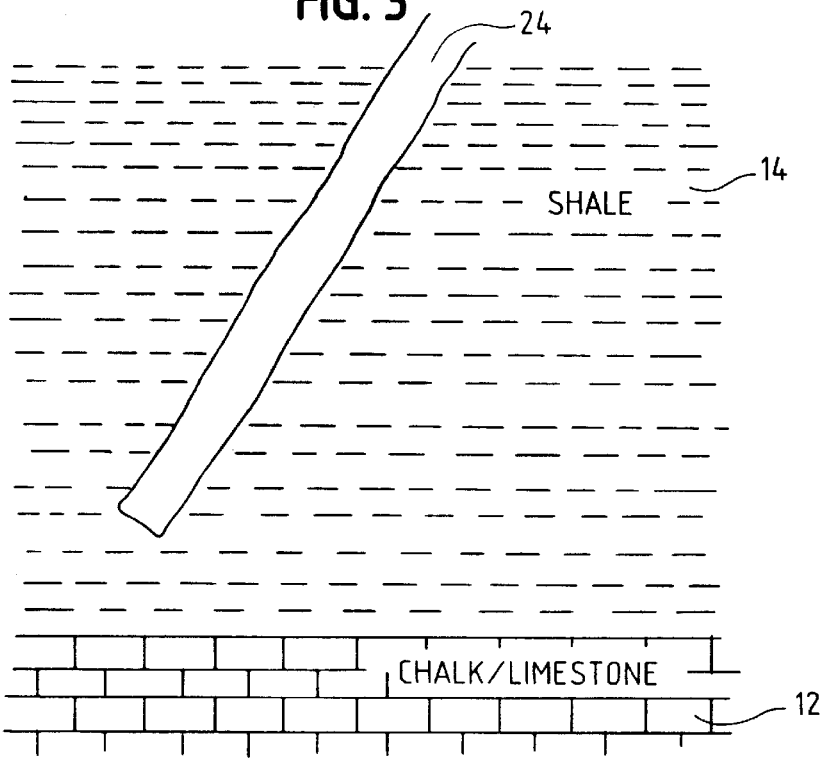
FIG. 3 is an enlarged view of the shale and chalk/limestone formations of FIG. 2 and showing a conventionally drilled wellbore that stops just above the top of the chalk/limestone formation in the shale overburden.

Referring to FIGS. 1A and 1B, a conventional drilling operation is illustrated with a drilling rig 22 for drilling an oil/gas wellbore 24. The drilling rig 22 generally includes a tall derrick structure 26 for stacking drill pipe 28 and casing pipe 30. To drill the wellbore 24, a turntable 32 on the derrick floor rotates the drill pipe string 28 for rotating a drill bit 34 carried on the bottom of the drill string 28 to cut into the formation therebelow. Mud 36 is circulated downhole by mud pump 38. When the mud reaches the surface, it passes over a vibrating screen 40 to filter out large cuttings before entering mud pit 41. The mud 36 then passes on to the settling tank 42 of the pit 41 where smaller particles settle out. The pump 38 draws the fluid from the pit 41 through a mud supply line 44 extending therebetween and out from the mud pump 38 to a drilling hose 46. The drilling hose 46 is attached to a swivel 48 on the top of kelly 50 that is connected to the string of drill pipe 28 extending down into the formation. The kelly 50 is generally a multi-sided length of heavy pipe that permits the rotary table 32 to grip and rotate the kelly 50, and hence the entire drill string 28, and yet have sufficient freedom so that it can slip vertically through the table 32 as drilling goes deeper.

The swivel 48 is suspended from a hook that is connected to a traveling block 52 or pulley, encased in a frame. Power is transmitted from an engine 53 to draw works 54, a winch that drives the rotary table 32 and also applies power for hoisting and lowering the pipe strings. The drilling cable runs from the draw works 54 over a crown block at the top of the derrick 22 and down to the traveling block 52. As previously mentioned, the mud is pumped through a hose 46 attached to the swivel 48. An opening in the center of the swivel 48 permits the mud to pass down through the attached drill string 28. After passing the vibrating screen 40, the mud discharges into the mud pit 41 at what should be a constant rate substantially equaling the rate of mud discharge downhole if the mud is properly circulating. However, where fluid losses are occurring downhole, the well operators will see the discharge to the mud pit slowing and the level of the mud pit 41 lowering.

Figure 4:
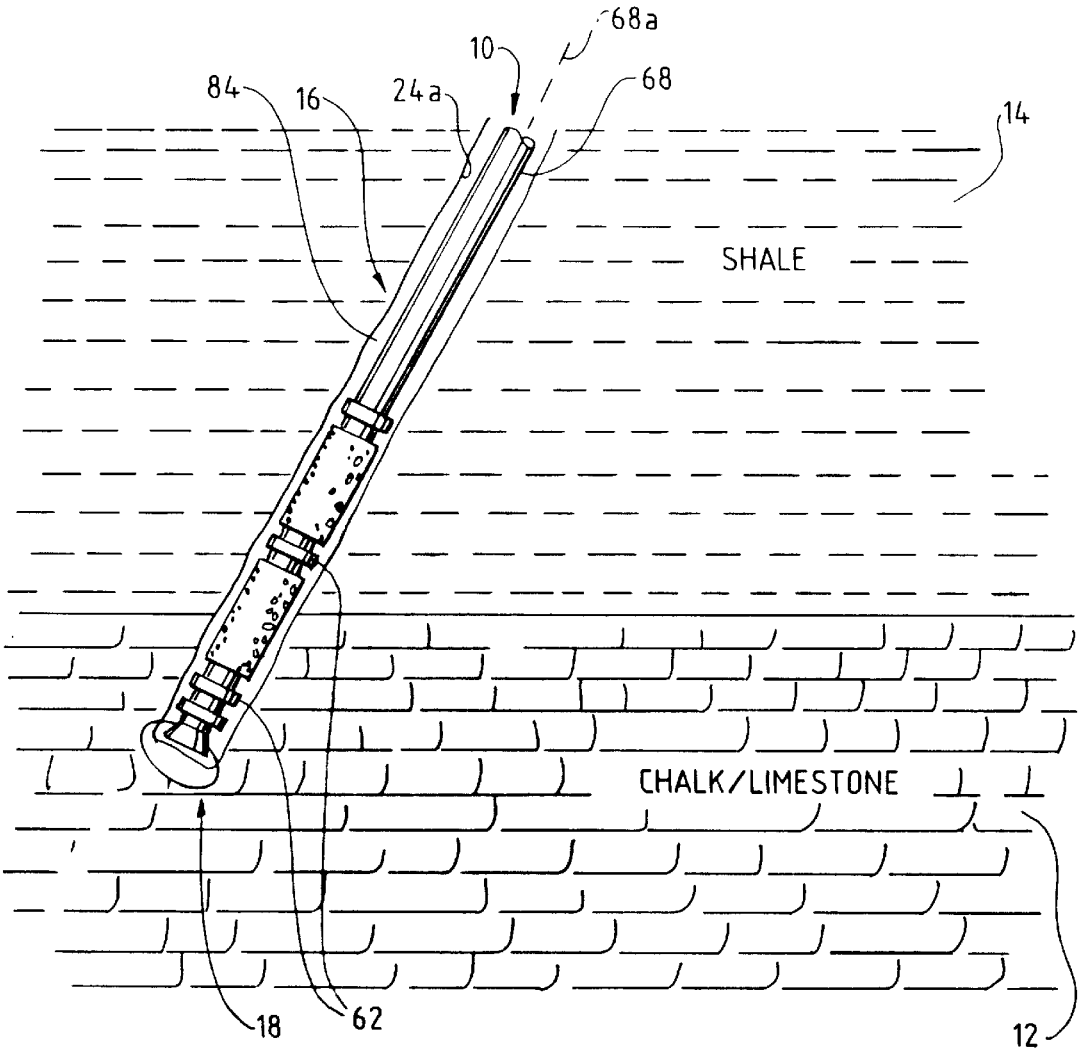
FIG. 4 is a view similar to FIG. 3 showing a liner assembly carrying isolation packers thereon drilling in the bore hole to extend it into the unstable or depleted chalk/limestone formation below the shale overburden.
Figure 5:
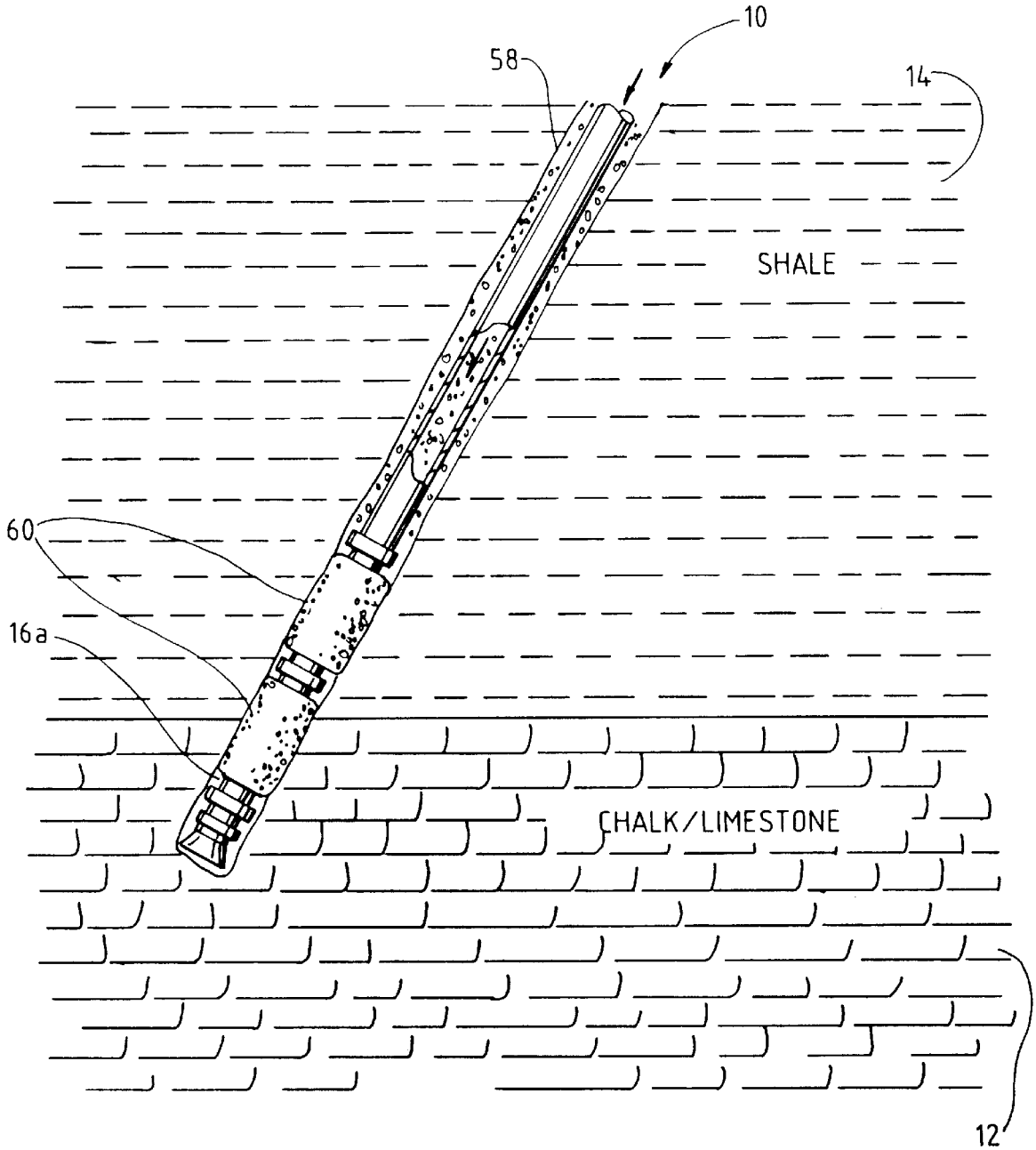
FIG. 5 is a view similar to FIG. 4 showing drilling with the liner assembly stopped to cement the liner in place and inflate the packers to isolate the shale overburden from the chalk/limestone underpressured formation.

In the present invention, once the wellbore 24 has been extended into the formation 14 in relatively close proximity to the underlying unstable or depleted formation 12 (FIG. 3), the drill pipe 28 and tri-cone bit 34 thereon are tripped out of the wellbore 24 and the liner drilling assembly 10 of the present invention is run into the bore for continuing the drilling thereof into the unstable or depleted formation 12, as best seen in FIG. 4. By utilizing the liner 16 having the rock cutting device 18 at its leading end, once the unstable or depleted formation 12 is penetrated, there is no need to pull drill pipe 28 from the hole for running casing pipe 30 to complete the wellbore 24. The liner 16 is designed so as to case off the wellbore, and as such normally will be a larger diameter and heavier pipe relative to the drill pipe 28. The diameter of the liner 16 and cutting device 18 utilized will be a function of the set casing 30 through which it must be run. Accordingly, the liner 16 can have a wide variety of diameters as conventionally are provided for performing the functions of drilling into the bore 24 and then being set by cement 58 therein to control the wellbore 24 where drilling into unstable or depleted formations 12.

Where the liner drilling assembly 10 is being utilized to drill into an underpressured formation 12, and upon seeing the mud level lower in the mud pit 41 indicating loss of returns, it is preferred that the liner 16 be set by pumping cement 58 downhole and inflating isolation packers 60 mounted thereon by the pumping action of the cement 58 so as to seal the overburden shale formation 14 from the underlying unstable or depleted chalk/limestone producing formation 12. As isolation packers 60 are mainly used in completion operations, it has been found that the rubber of the packers 60 tends to be damaged while drilling in tight holes as may occur when drilling with the larger diameter liner assembly 10 herein. To minimize damage to the packers 60 while running the liner assembly 10 downhole and drilling therewith, the liner assembly 10 preferably has rigid stabilizer 62 thereon, as shown in FIGS. 4 and 5. However, because of the larger diameter of the liner 16 versus conventional drill pipe 28 and thus the smaller annulus, it is desirable that equipment carried on the outside of the liner wall 68 be kept to a minimum. Where it is difficult to run the packers 60 without losing them downhole, other means for sealing the formations 12 and 14 can be utilized, such as by running a plug (not shown) inside the liner 16. Other options include using packers of shorter lengths or, instead of a rubber-type packer, an expandable full-bore liner constructed from an alloy material that can be expanded from a collapsed state. In the alternative, the liner may be drilled in place, set, perforated and cemented to isolate the zone. A mechanical cementing stage tool may be used instead of perforating the liner.

Figure 6A:
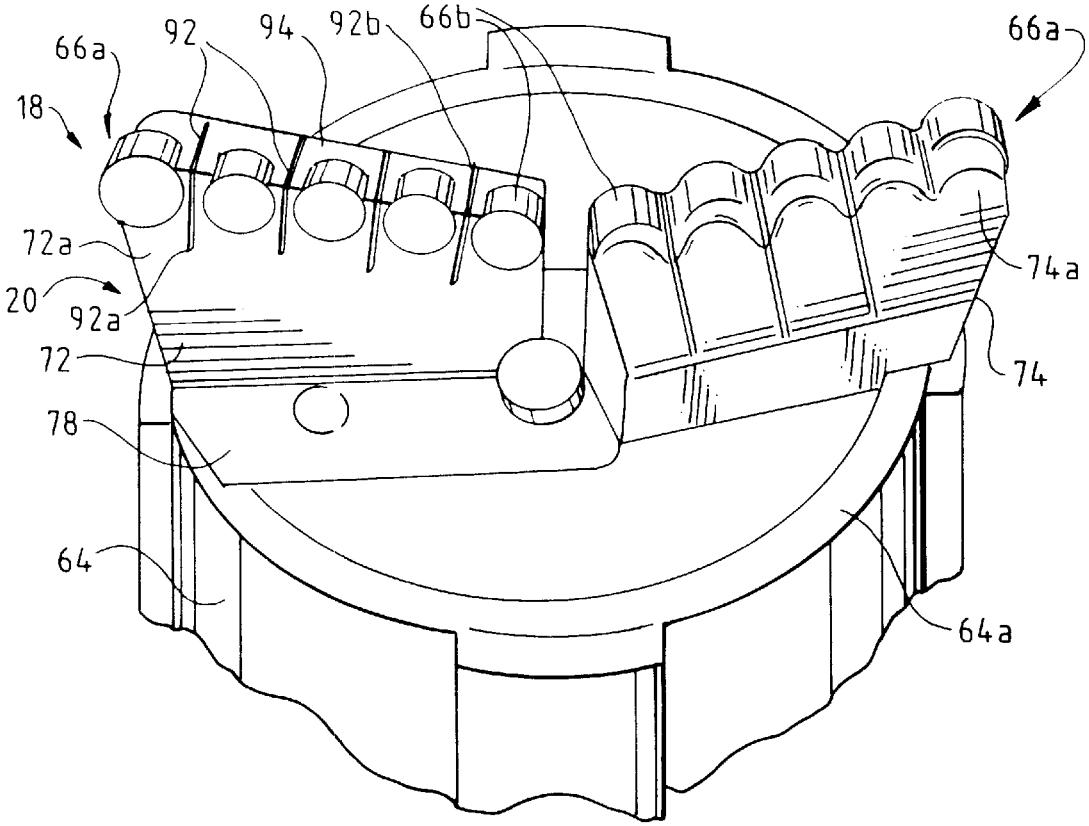
FIG. 6A is a perspective view of a partially completed shoe of the liner assembly having cutting elements on radial mounting blades on the shoe with relief slots formed therein.
Figure 6B:
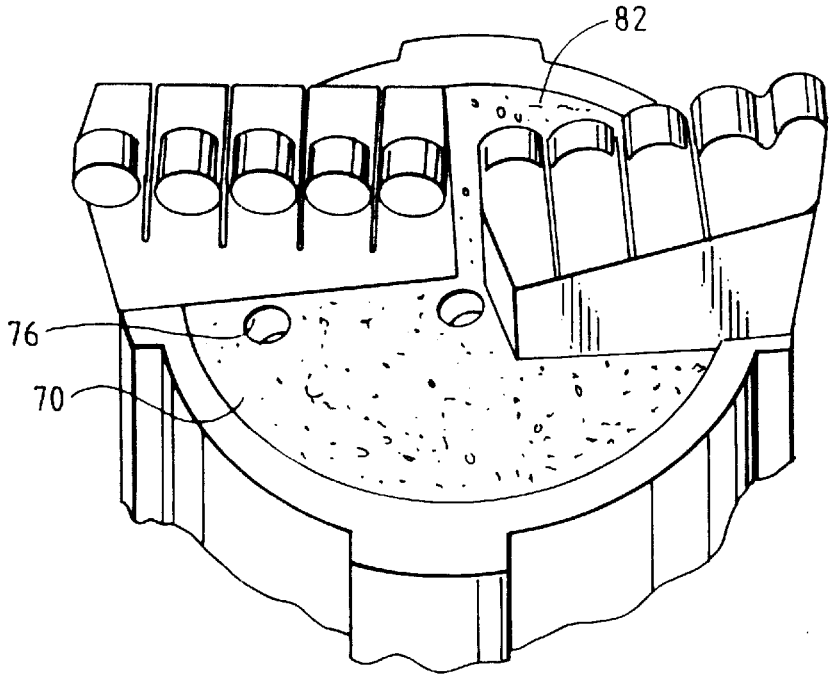
FIG. 6B is a view similar to FIG. 6A showing the shoe completed by adding cement.

The cutting device 18 preferably is in the form of a drill shoe 64 such as illustrated in FIGS. 6A and 6B. The drill shoe 64 can be a short length of pipe that can be threaded onto the bottom of the liner 16 so that to generate cutting action with the drill shoe 64, the liner 16 must be rotated as by attachment at its upper end to the rotating drill string 28. The invention also contemplates rotating the cutting device 18 without having to rotate the liner 16, as by providing a downhole turbine or mud motor (not shown) as is known; however, the use of a rotary liner assembly 10 is preferred. The shoe 64 has cutters or cutting elements 66, and the diameter of the wellbore 24 that the drill shoe 64 will drill is determined by the position of the gauge or outermost cutting elements 66*a* thereon. The cutting elements 66*a* are preferably carbide or PDC cutters to provide good penetration rates and cutter strength.

The liner 16 has an annular wall 68 having longitudinal axis 68*a* extending therethrough with the shoe 64 being coaxial therewith for rotation of the liner 16 and shoe 64 about the axis 68*a*. Preferably, the liner wall 68 has a predetermined diameter thereof that is slightly smaller than the diameter of the face 70 across the shoe 64. The shoe face 70 has a number of generally radially extending mounting blades 72 and 74 having upper sections 72*a* and 74*a* thereof for mounting of the cutting elements 66 spaced or distal from the shoe face 70. The blades 72 and 74 can be made from a drillable material, for instance, 4140 steel, to provide them with strength and yet allow them to be drilled such as with carbide cutters. The two-blade design herein is preferred so as to minimize the amount of steel material that have to be milled and cutting elements 66 that have to be released for subsequent drilling through the drill shoe 64, as will be more particularly described herein. With the shoe face 70 of slightly larger diameter than the liner annular wall 68, the outermost cutting elements 66*a* are positioned at or slightly beyond the periphery of the shoe face 70 so as to drill a bore 24 with sufficient clearance for the liner wall 68 therein. The drill shoe 64 of FIGS. 6A and 6B has the outermost cutting elements 66*a* mounted slightly beyond the periphery of the shoe face 70.

As can be seen in FIG. 6A, the blades 72 and 74 are attached to the end 64*a* of the shoe 64 as by welding. Alternatively, the blades can be treaded onto the pipe body or machined integral to the pipe body. Drilling fluid openings or nozzles 76 are formed in the respective blade bases 78 and 80 through which the drilling mud 36 can flow. The drilling fluid openings 76 are plugged such that when completing the drilling shoe 64 by adding drillable material or liner fill cement 82 thereto, the plugs can be removed so as to form the openings through the cement material 82, as shown in FIG. 6B. Copper tubes or other drillable tubing (not shown) extend from the drilling fluid openings 76 inside of the shoe with the area between the blades 72 and 74 and just to the top of the flow tubes being cemented with the material 82 to isolate the flow inside the flow tubes and out through the nozzle openings 76.

Figure 7:
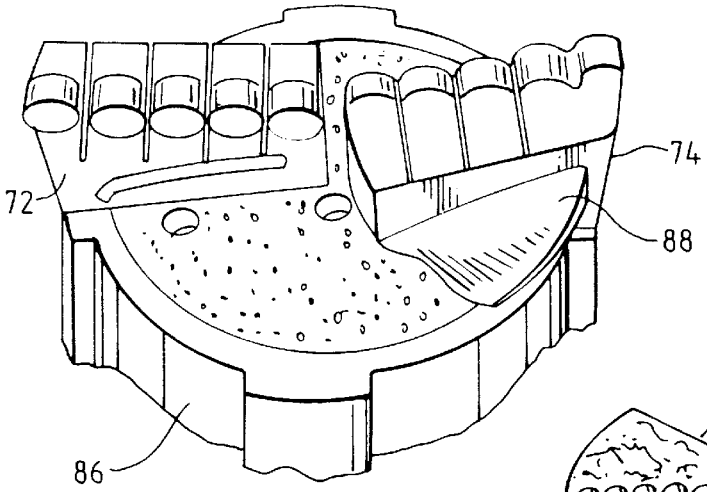
FIG. 7 is a perspective view of an alternative bit design similar to the bit of FIGS. 6A and 6B showing reinforcement added to the blades to minimize blade shearing.

Other variables that affect the fluid hydraulics include the thickness across the blades 72 and 74, the blade stand-off or height from their respective bases and the number, location and size of the nozzle openings 76. By way of example, in the design of FIGS. 6A and 6B, a blade thickness of between approximately 3 to 4 inches has been utilized with a blade stand-off of between approximately 2 to 4 inches with the blade width and height coordinated to provide good blade strength and fluid hydraulics for cleaning of the cutter/rock interface. A nozzle diameter of between approximately ¾ to 1 inch can be provided that should minimize potential plugging with the drilling fluid mud 36 while still providing good hydraulic energy for the mud 36 flowing from the nozzles 76 with two such nozzles 76 formed in each blade base 78 and 80. The backrake of the cutters is decreased from the normal 20° to between approximately 10° to 15° and 19 mm PDC cutters 66 were used for good ROP and cutter strength. FIG. 7 illustrates another shoe 86 similar to the shoe of FIGS. 6A and 6B except having the addition of support sections 88 behind the blades 72 and 74 thereof to further improve the strength of the shoe bit 64.

The two-bladed design with each blade 72 and 74 carrying its own set of cutters 66 mounts the cutting elements 66 thereon so that they extend in substantially straight line alignment with each other generally radially, similar to the mounting blades 72 and 74, from the innermost cutter 66*b* on the radially inside ends of the blades 72 and 74 to the outermost cutter 66*a* on the radially outer ends of the blades 72 and 74. The innermost cutters 66*b* are preferably on generally opposite sides thereof spaced from the central axis 68*a* of the liner assembly 10 so as to mount the blades 72 and 74 and their cutting elements 66 for eccentric rotation relative to the liner 16 and shoe 64 as the liner assembly 10 is rotated about the axis 66*a*. In other words, extending the line of the cutters 66 beyond the innermost ends of the blades will not intersect the axis 68*a*. In this manner, the shoe 64 including the blades 72 and 74 and cutters 66 thereof will pass through a hole that has a diameter that is smaller than the diameter of the bore that the shoe 64 will cut. Other variables that affect the fluid hydraulics include the thickness across the blades 72 and 74, the blade stand-off or height from their respective bases and the number, location and size of the nozzle openings 76. By way of example, in the design of FIGS. 6A and 6B, a blade thickness of between approximately 3 to 4 inches has been utilized with a blade stand-off of between approximately 2 to 4 inches with the blade width and height coordinated to provide good blade strength and fluid hydraulics for cleaning of the cutter/rock interface. A nozzle diameter of between approximately ¾ to 1 inches can be provided that should minimize potential plugging with the drilling fluid mud 36 while still providing good hydraulic energy for the mud 36 flowing from the nozzles 76 with two such nozzles 76 formed in each blade base 78 and 80. The backrake of the cutters is decreased from the normal 20° to between approximately 10° to 15° and 19 mm PDC cutters 66 were used for good ROP and cutter strength. FIG. 7 illustrates another shoe 86 similar to the shoe of FIGS. 6A and 6B except having the addition of support sections 88 behind the blades 72 and 74 thereof to further improve the strength of the shoe bit 64.

With respect to the fluid hydraulics, it is important that the mud flow from the nozzles 76 with sufficient force so that it sweeps the area at the interface between the cutters 66 and the formation rock clean from cuttings so as to prevent balling problems on the shoe 64 around the blades 72 and 74 thereof that would prevent effective cutting therewith. The proper shoe design is a compromise between having the shoe bit 64 combat balling problems while minimizing the tendency for harmful bit vibrations. It has been found that the cleaning by the mud 36 is made more difficult where there is low hydraulic energy such as with relatively large nozzles in combination with a longer distance to the cutter/rock interface or high stand-off of the blades 72 and 74. The addition of supports 88 behind the blades 72 and 74 can also increase the balling tendency by creating stagnation zones where cuttings can collect and adhere to the shoe bit. As is apparent, optimizing the fluid hydraulics for the shoe bit 64 and 86 is a compromise between a wide variety of factors with the proper design taking into consideration the sizing and location of the nozzles 76 in relation to the mounting blades 72 and 74 and, with respect to the mounting blades themselves, the width and height of the blades 72 and 74, and the number, position and orientation of the cutters 66 carried thereby.

Another feature designed into the shoes 64 and 86 deals with the tendency of bits to undergo harmful bit vibrations or "whirling" when drilling downhole due to their asymmetric design. In this regard, bits have been designed with anti-whirl technology that is more fully described in U.S. Pat. No. 5,402,856, assigned to the assignee herein and that is incorporated by reference, where the resultant radial forces from the cutting action of the cutters 66 are directed to a predetermined location along the shoe 64. By directing the resultant forces towards a predetermined location, the shoe will maintain engagement with the wellbore sidewalls 24*a* thereat while rotating for drilling downhole so as to prevent the occurrence of destructive whirl within the bore hole 24. As seen in the design of the alternative shoe bit 90 of FIG. 12A, the resultant forces will be directed to a location behind the blade arm 74, that in the design of shoe bit 90 has a larger number of cutting elements 66 mounted thereon versus blade arm 72. Thus, the present invention provides a rotary liner assembly 10 having a bi-center and anti-whirl shoe bit design so that the liner assembly 10 drills a bore 24 having a sufficiently sized annulus 84 to minimize head losses in the mud 36 circulated therein, while also maximizing the ROP for the shoe bit by minimizing balling and vibrations as it drills.

Figure 8:
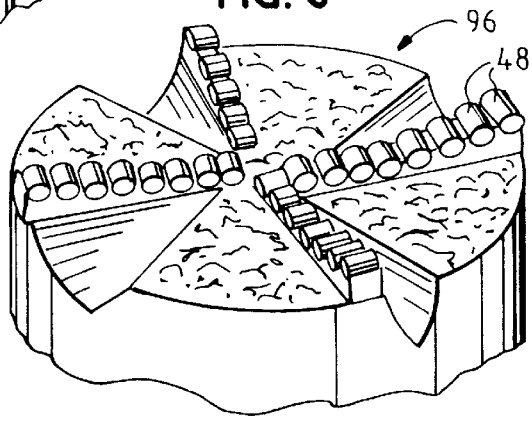
FIG. 8 is a perspective view of a metal muncher bit for drilling through the shoe.
Figure 9A:
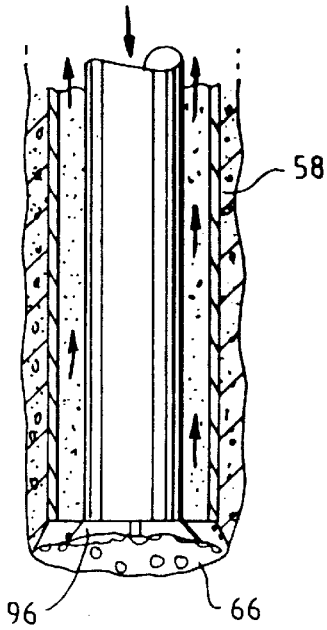
FIGS. 9A and 9B are elevational views partially in section showing the metal muncher bit drilling through the liner assembly shoe with the mud carrying the cutting elements released from the shoe back up to the surface.
Figure 9B:
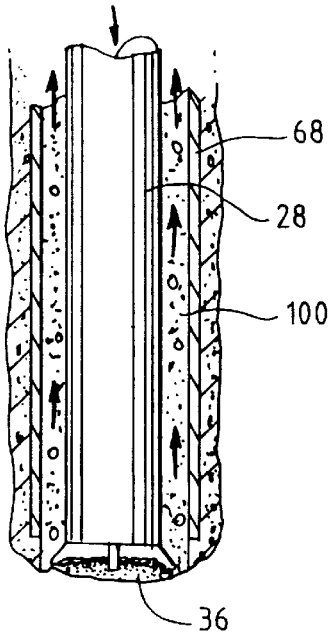

As previously mentioned, one important feature of the present invention is that the set liner assembly 10 be provided with a portion 20 that is drillable so that if subsequent drilling past the set liner assembly 10 is desired, the drillable portion 20 provides a way to drill past the liner assembly 10 without having to pull the cutters 66 out from the bore hole 24. In this regard, the drilling shoe 64, and more particularly, the mounting blade upper sections 72*a* and 74*a* to which the cutting elements 66 are mounted are optionally provided with relief spaces or slots 92 between adjacent cutters 66. As can be seen in shoes 64, 86 and 90, the relief slots 92 are formed in the mounting sections 72*a* and 74*a* of respective blades 72 and 74 and extend between the cutters 66 and open to the distal surface 94 of the blades 72 and 74. The bottoms of the reliefs 92 are vertically offset from each other so that the radially outermost relief 92*a* has a bottom that is further from the shoe face 70 than the bottom of the next adjacent slot 92 with the radially innermost relief 92*b* having the closest bottom. The relief slots 92 allow the shoes 64, 86 and 90 to be drilled by a drill bit, such as the metal muncher junk mill 96 of FIG. 8 on the end of the drill string 28 while minimizing contact of the cutters 98 of the junk mill 96 with the shoe cutting elements 66 by allowing them to release as the mill 96 drills through the mounting blades 72 and 74 (FIGS. 9A and 9B). The junk mill 96 can have 10 mm carbide cutters that should be sufficient to mill through the steel of the blades 72 and 74 in a relatively short time.

As can be seen in the drawings, the shoe bits are designed so that their cutters 66, similar to the relief slots 92 therebetween, are inclined relative to the shoe face 70 so that the radially innermost cutters 66*b* are closer to the face 70 than the radially outermost cutters 66*a*. In this manner, the cuttings from rotating the shoe bits 64, 86 and 90 downhole will more readily be flushed from the inner cutters 66*b* radially outwardly to the periphery of the shoe face 70 for being cleaned away from the interface between the cutters 66 and formation rock and then up annulus 100 between the drill pipe 28 and the interior of the liner wall 68, as best seen in FIGS. 9A and 9B. In particular, the bit 96 will reach and cut through the reliefs 92 in order from the radially innermost relief 92*b* and then through successive relief slots 92 until it reaches the radially outermost relief 92*a* whereupon all the cutters will have released from their mounting blades 72 and 74 or be pushed radially out beyond the liner wall 68 so as to minimize damage to the cutters 98 on the bit 96 as it travels through the bottom of the liner 16. In this manner, the present invention provides a robust liner assembly 10 that can drill into unstable or depleted formations 12 (FIG. 4), be set therein by cement 58 for casing off and securing the wellbore walls 24 and/or isolating formations 12 and 14 from each other as by inflation of packers 60 (FIG. 5) or utilizing other sealing means, and then, if necessary, allowing for subsequent drilling to occur beyond the liner assembly 10 for penetrating deeper into the unstable or depleted region 12, and if underpressured adjusting the mud weight accordingly, or beyond into producing formations therebelow and without causing substantial damage to the bit 96 utilized for such drilling, despite the fact that the cutters 66 are not pulled from the bore 24. The ability to set the liner 16 in the bore 24 with the cutters 66 staying downhole provides significant savings in drilling rig time; and, where fluid losses are occurring, such losses can be minimized as weighted fluid need not be kept in the annulus for as long a period of time.

Figure 10A:
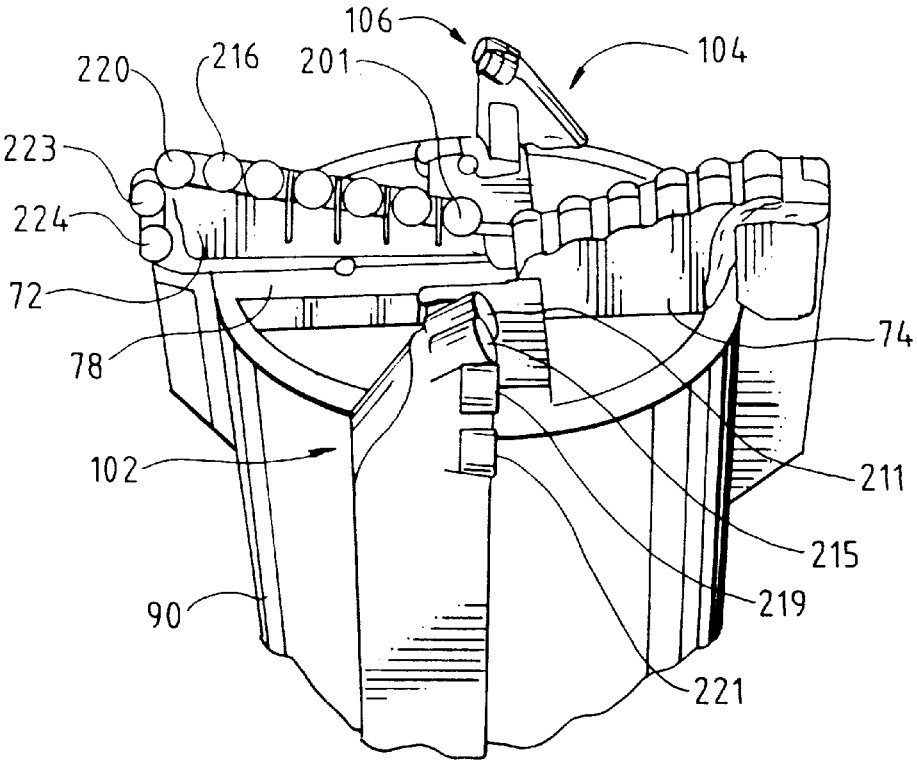
FIGS. 10A and 10B are perspective views of an alternative bi-center bit design having bearing cutters or pads in addition to the radial blade cutters.
Figure 10B:
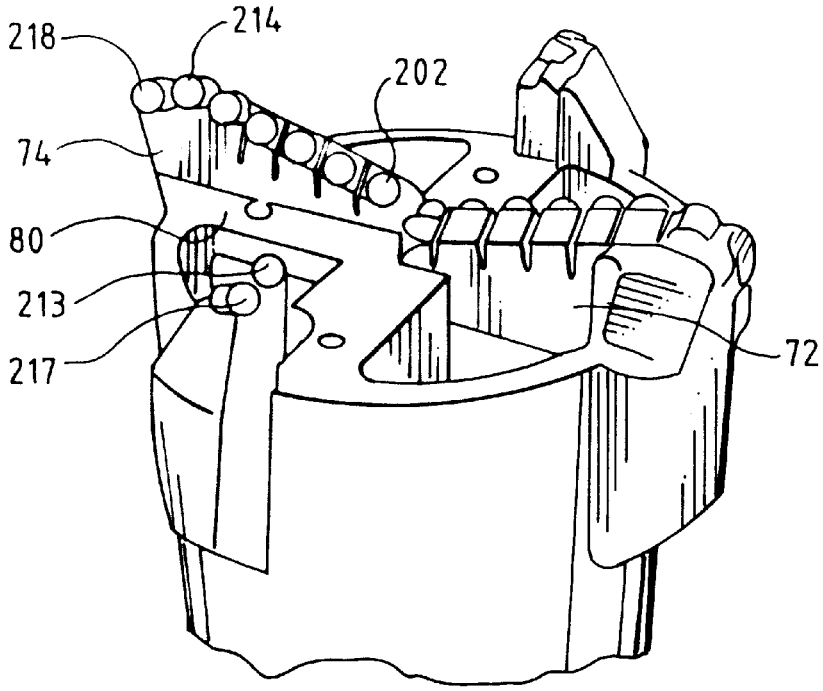

Turning to FIGS. 10A and 10B, the shoe bit 90 shown for the liner assembly 10 is similar to the previously described shoes 64 and 86 in that it has both a bi-center and anti-whirl design. However, the shoe 90 is slightly larger having a greater number of cutting elements 66 mounted on the blades 72 and 74 thereof. For ease of reference, the cutting elements 66 of the shoe 90 have been provided with reference numerals 200 through 224 with their positions and geometry more readily understood from a reference to FIGS. 11A and 11B.

Figure 11A:
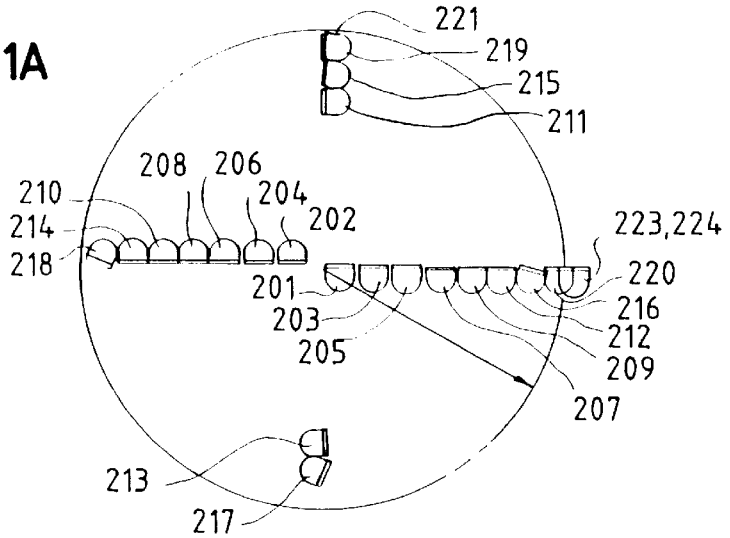
FIG. 11A is a schematic view of the bi-center bit design of FIGS. 10A and 10B and indicating the resultant forces from the cutting action of the cutting elements being directed to a predetermined location on the bit body to provide an anti-whirl design.

The blade arm 72 is provided with nine (9) cutting elements 66 thereon whereas the blade arm 74 is provided with seven (7) cutting elements 66 thereon. As previously mentioned, the resultant forces from the cutting action of the cutting elements 66 is directed towards a predetermined location on the shoe 90 behind the blade 72 with the increased number of cutting elements 66 thereon, as shown in FIG. 11A. In addition to cutting elements 66, the shoe 90 is provided with bearing regions 102 and 104 that carry bearing cutters or pads 106 thereon for riding along the bore hole wall 24*a* as the shoe 90 is rotated for drilling downhole. FIG. 11A illustrates the canting of the various cutters 66 relative to a vertical reference plane. The outermost cutter 218 on arm 74 is shown to be canted so as to face radially outward with respect to the remaining cutters on the arm 74. Arm 72 is provided with a pair of vertically spaced gauge or outermost cutters 223 and 224 with the cutter 220 adjacent the outermost cutter 223 being spaced slightly out of radial alignment with the remaining cutters on the arm 72. In addition, cutter 216 adjacent cutter 200, similar to cutter 218 of arm 74, is canted radially outward with respect to the remaining cutters on arm 72.

With continuing reference to FIG. 11A, the bearing cutters in bearing region 102 are all canted with cutters 215, 219 and 221 canted radially outward and innermost cutter 211 canted radially inward. It will be noted that bearing cutters 219 and 221 are vertically spaced from each other. It will be noted that bearing cutters 219 and 221 are vertically spaced from each other and, as such, are shown in overlapping orientation according to the plan view of FIG. 12A. On the other side of the shoe 90 in bearing region 104, the innermost bearing cuter 213 is not canted while the outermost bearing cutter 217 is canted radially outward.

Figure 11B:
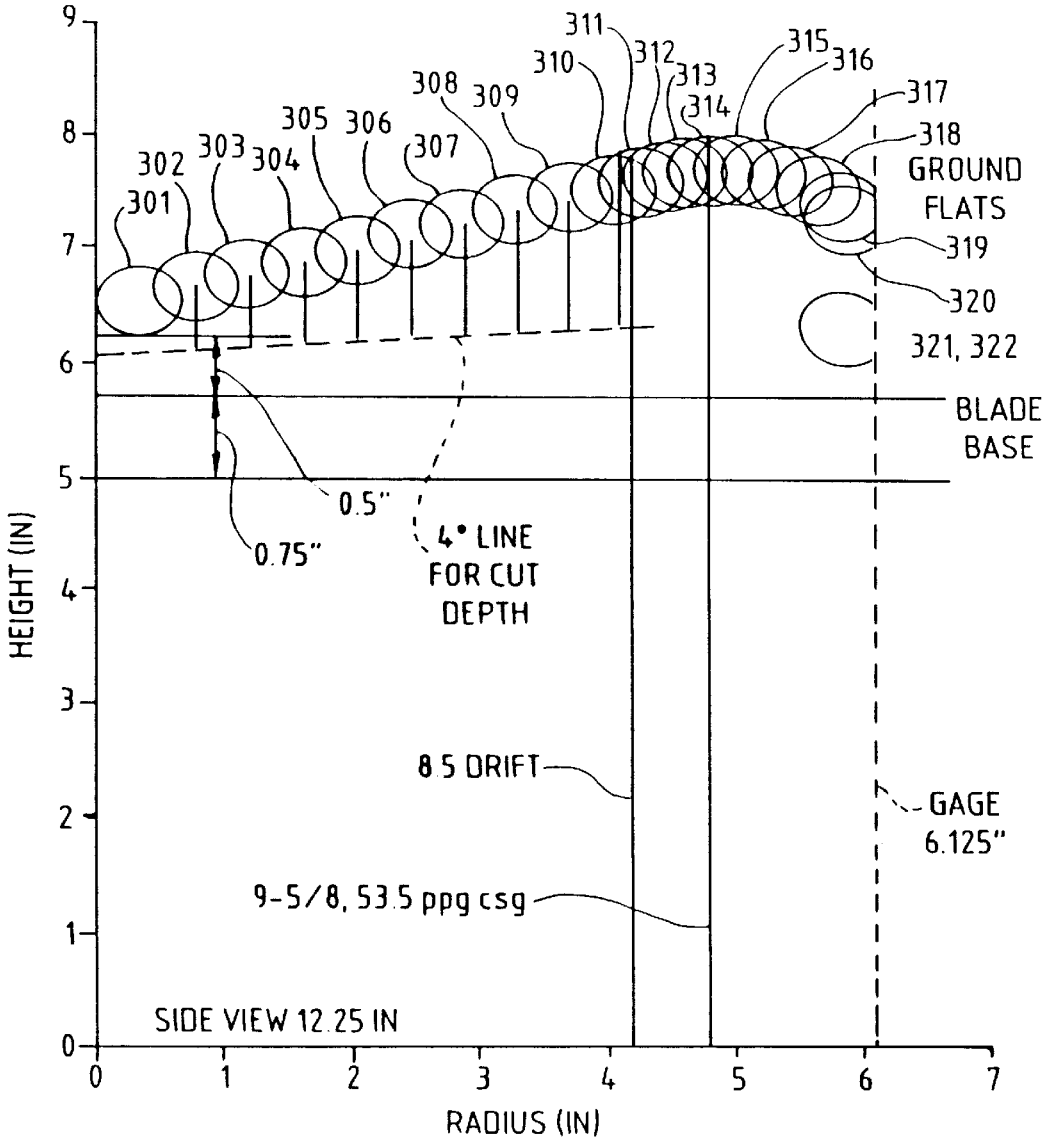
FIG. 11B is a graph illustrating the relative positions of the cutting elements of the bit of FIGS. 10A and 10B and FIG. 11A to obtain good fluid hydraulics and the anti-whirl characteristics for the bit.

FIG. 11B illustrates the relative positions of the cutters 66 on shoe 90 with respect to their stand-off from the shoe face 70. As is shown on the graph, the cutters on the arms 72 and 74 generally alternate in their height above the blade face 70 so that each cutting element 66 cuts at a different level in the bore hole than the other cutters 66 on both the arm to which it is mounted and with respect to the cutters 66 on the other blade arm. In other words, preferably no cutter 66 will be at the same stand-off distance. Similar to the shoes 64 and 86, the cutting elements 66 progress from the cutting elements 201 and 202 closest to the face 70 at the radially innermost position on the shoe face 70 to a crest with cutters 66 farthest from the face 70 that, in this instance, are cutters radially inward of the outermost cutters, that is cutter 214 on arm 74 and bearing cutter 215 on bearing region 102. As indicated on the graph, the shoe 90 is formed with ⅝ inches, 53.5 ppg casing having an inner 8.5 inches drift diameter with its bi-center design such that it will cut a wellbore of 12.5 inches in diameter to provide the liner 16 with sufficient clearance from the bore hole wall 24*a*.

Figure 12A:
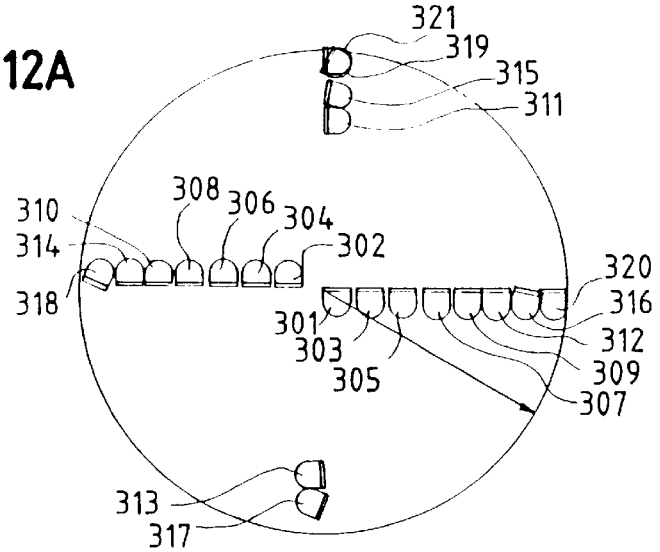
FIGS. 12A and 12B are views similar to FIGS. 11A and 11B of an alternative non-bi-center bit design having a lesser number of cutters that also has the resultant forces from the cutting elements being directed to a predetermined location on the bit body to provide an anti-whirl design.
Figure 12B:
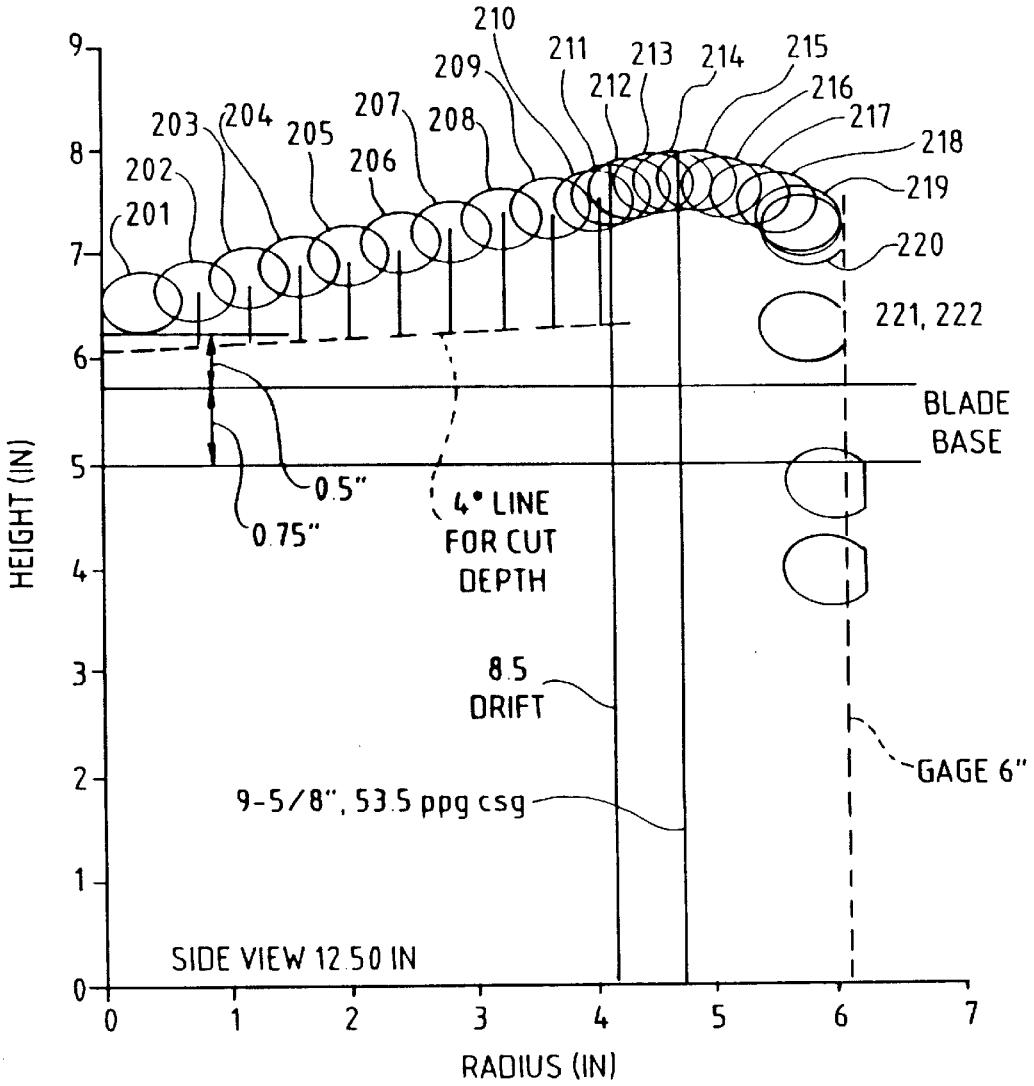

FIG. 12A and 12B show the design of the cutters 66 of another shoe similar to that of shoe 90 except with a lesser number of cutting elements that cuts a slightly reduced diameter bore 24 of 12.25 inches. The cutting elements 66 of the design of FIGS. 12A and 12B are provided with reference numerals 301 through 322. More particularly, corresponding arm 72 has one less cutter, or eight cutters 66, while arm 74 has the same number of cutters 66, seven, as in shoe 90. The canting of the cutters 66 are also slightly different so that cutter 314 is canted slightly radially outward, although less so than cutter 318. Cutter 316 on the other arm is canted radially outward similar to corresponding cutter 216 on bit 90. However, radially inner adjacent cutter 312 is slightly recessed with respect to the radial alignment of the remaining cutters of that arm. As to the corresponding bearing regions, the arrangement of the bearing cutters 106 on corresponding bearing region 102 is substantially the same, while the arrangement of cutters 106 in bearing region 104 cant cutter 319 to a greater degree radially outward than the corresponding cutter 219 of shoe 90. In both instances, the shoe designs provide bi-center and anti-whirl characteristics to the shoe used on the liner assembly 10.

Figure 2:
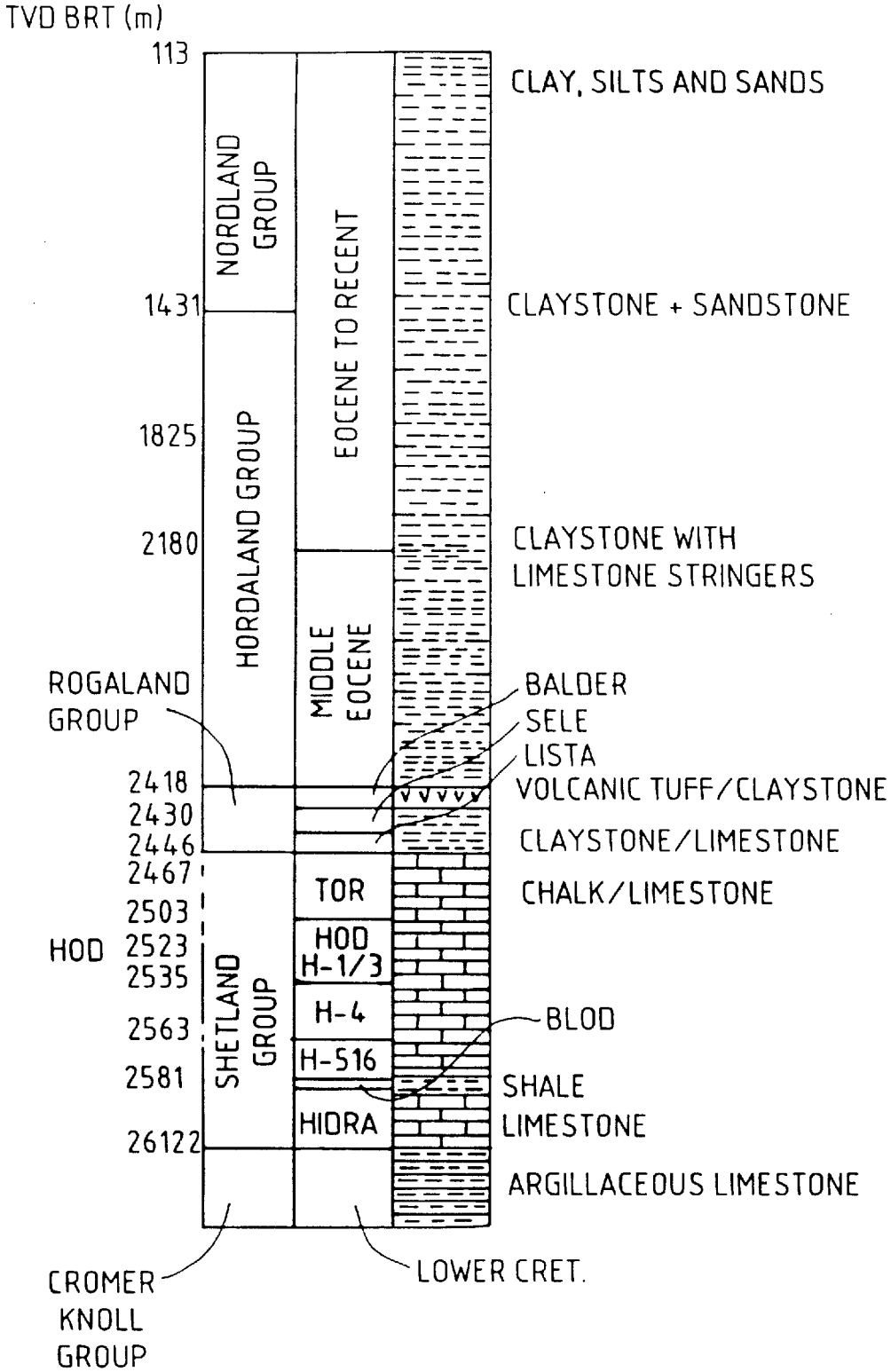
FIG. 2 is a schematic illustration of a particular formation lithology in which the method and drilling assembly of the present invention can be used showing a shale overburden section overlying a chalk/limestone reservoir.

When drilling a bore 24 through offshore formations as illustrated in the general stratigraphic column of FIG. 2, and more specifically in the formations 12 and 14 of FIGS. 2 through 5, it has been found that utilizing the method and liner drilling assembly 10 of the present invention has provided substantial savings in time and thus money, as time for the offshore rig in this instance is estimated at approximately $180,000 per day. In particular, the chalk in the field of FIG. 2 has extremely high porosity with a relatively weak matrix strength that provides reservoir energy through pore compressibility. Solids production, compaction of the reservoir, and its subsidence effects are features that challenge production. Reservoir compaction and depletion are the primary features that affect drilling operations. Successful development of such a field is dependent on the ability to control solids production without inhibiting the production of oil. During drilling operations, the shale overburden (Lista) must be penetrated and the hole drilled and cased as close as possible to the Tor reservoir to prevent wellbore instability problems. This is due to the high differential pressure between the Lista and Tor formations. At 2,450m, the hydrostatic pressure in the Lista shale is 6,150 psi requiring a mud weight of 14.7 ppg and the pressure inside the Tor was predicted to be 2,700 to 3,300 psi requiring a mud weight in the range of 6.4 to 7.8 ppg.

For comparison, a sidetrack well was drilled into the Lista and Tor formations using an 8½-inch pipe section for casing above the producing zone with the producing zone being completed with a 5-inch liner that took approximately 33.8 days from spud of the 8½-inch section to completing the cleanout of the 5-inch liner before the well was on-line for production. The goal was to set a 7-inch liner as close as possible to the Tor to prevent wellbore stability problems, yet minimize well control risks associated with mud losses into the depleted pay section. This strategy resulted in significant down time primarily relating to poor wellbore stability. Hole enlargement, poor cuttings transport, stuck pipe and over one-thousand barrels of oil losses ($250 per barrel) were a few of the problems.

As mentioned above, because these were offshore wells, instead of drilling another well, a steerable assembly was used to sidetrack from inside of the existing casing to minimize the cost of redrilling these wells. It has been found that when drilling and sidetracking through the existing casing, it is preferable to perform a squeeze cementing job around the window formed in the existing casing through with the steering assembly is drilled so as to minimize lost circulation problems thereat. After kicking out of the existing casing and drilling to near the top of the underpressured Tor formation, the liner assembly 10 was then run to bottom with drilling proceeding keeping a close watch on the pressure readings at the pump 38 and the level in the mud pit 41. When the pressure dropped with a corresponding loss of returns, the mud was switched from a 14.5 ppg mud to a 10 ppg mud with base oil being used to keep the annulus full. After reaching approximately 10 feet into the Tor formation, drilling was stopped, the cement lines were hooked up and cement 58 pumped downhole for setting the liner assembly 10 with the liner 16 spanning the formations 12 and 14 with section 16*a* thereof set in the underpressured Tor formation 12. Thereafter, a mill bit 96 drilled through the liner shoe and another such bit was used to drill to total depth whereupon a 5-inch heavy wall liner was run into the bore and cemented in place with the well then being ready to be placed on production. Utilizing the method and liner assembly 10 of the present invention cut the time from 33.8 days to 12.1 days from spud of the 8½-inch section to cleanout of the 5-inch liner, yielding a savings of $2.17 million based on estimated rig costs of $100,000 per day (now $180,000 per day). As is apparent, the economic benefits of the present invention can be substantial.

Figure 13A:
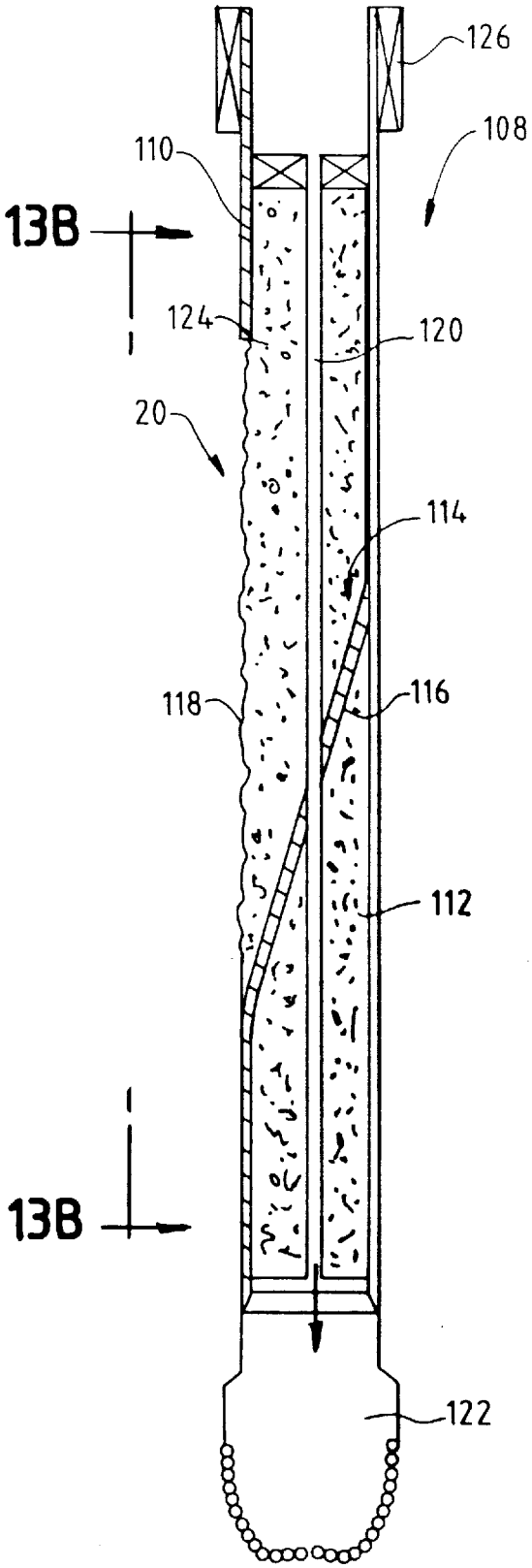
FIG. 13A is an alternative liner assembly according to the present invention showing a liner having a whipstock deflection plate preformed therein adjacent a window of drillable material on the liner assembly.
Figure 13B:
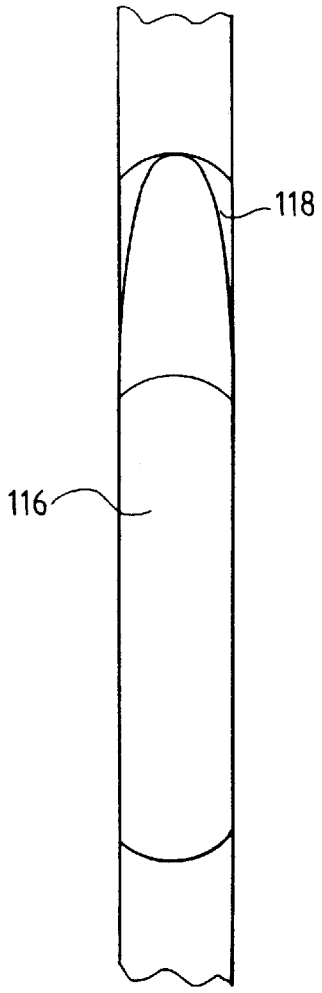
FIG. 13B is an elevational view of the window of FIG. 13A taken along line 13B—13B of FIG. 13A.

FIGS. 13A and 13B illustrate an alternative liner drilling assembly 108 in accordance with the present invention. The liner drilling assembly 108 includes an annular liner wall 110 having an interior 112 thereof in which a built-in whipstock 114 is provided. The whipstock 114 includes a deflection plate 116 inclined relative to the longitudinal axis of the wall 110. The liner annular wall 110 is pre-formed so that a section thereof adjacent the whipstock 114 is a window 118 of material adapted to be drilled. In other words, the window section 118 is made from a material different from the remainder of the wall 110 and one that is more easily drilled than is the normal wall material. A drillible sleeve (not shown), such as a fiberglass or aluminum sleeve, can be added to cover the window 118 to impart strength to the liner wall 110. The casing or liner wall 110 is pre-milled with the window 118 that preferably is between approximately 15 to 30 feet in length. The casing whipstock 114 is welded in place along the drillable flow conduit 120 allowing mud flow to the bit 122. The whipstock deflection plate 116 generally extends along the bottom two-thirds of the liner window 118. A drillable filler material 124, such as a cement, phenolic plastic or rubber filler material, fills the liner wall interior space 112 around the whipstock 114 so as to isolate the inside of the casing window 118 until time to sidetrack, as will be described hereinafter.

It is important to have high quality drillable filler material 124 with the liner drilling assembly 108 having the window 118 formed therein so as to prevent the liner wall 110 from yielding during rotary drilling therewith. The introduction of the window substantially decreases the torsional stiffness of the liner wall 110 and simultaneously increases the stress level to which the wall 110 will be subjected. Where competent cement material 124 fills the interior space 112, the torsional stiffness is decreased by a factor of roughly 12 so that the shear stresses as seen in the liner 108 with the window 118 are approximately twice those seen in a liner without such a window 118. Where the casing or liner is a 7 inch, 29 ppf, N80 material, the torsional yield of the liner wall 110 is approximately 101,000 foot-pounds. Where a properly cemented liner 110 with a window 118 is utilized, there should be approximately a one-half reduction that will result in a torque capability of approximately 50,000 foot-pounds that is still higher than the maximum yield torque of the Hydril 521 connections typically utilized in the liner string of 46,000 foot-pounds. Without the cement 124, milling a window 118 reduces the torsional strength by a factor of 50, that makes the yield strength of the liner wall 110 approximately 2,000 foot pounds.

Thus, the use of the proper filler material 124 allows the liner drilling assembly 108 to be used safely for drilling the bore hole 24. Once the liner assembly 108 has penetrated the formation 12, the liner assembly 108 can be set by pumping cement downhole for securing the liner wall 110 in the bore hole 58 and to inflate isolation packer 126 carried thereby, as described with respect to the liner drilling assembly 10. When drilling is to be extended beyond the set liner assembly 108, a drill bit, such as a conventional roller-cone bit, can be utilized to drill through the drillable filler material 124 until the bit engages deflection plate 116 leading it to drillable window material 118 so as to avoid the bit 122 on the bottom of the liner wall 110.

Figure 14:
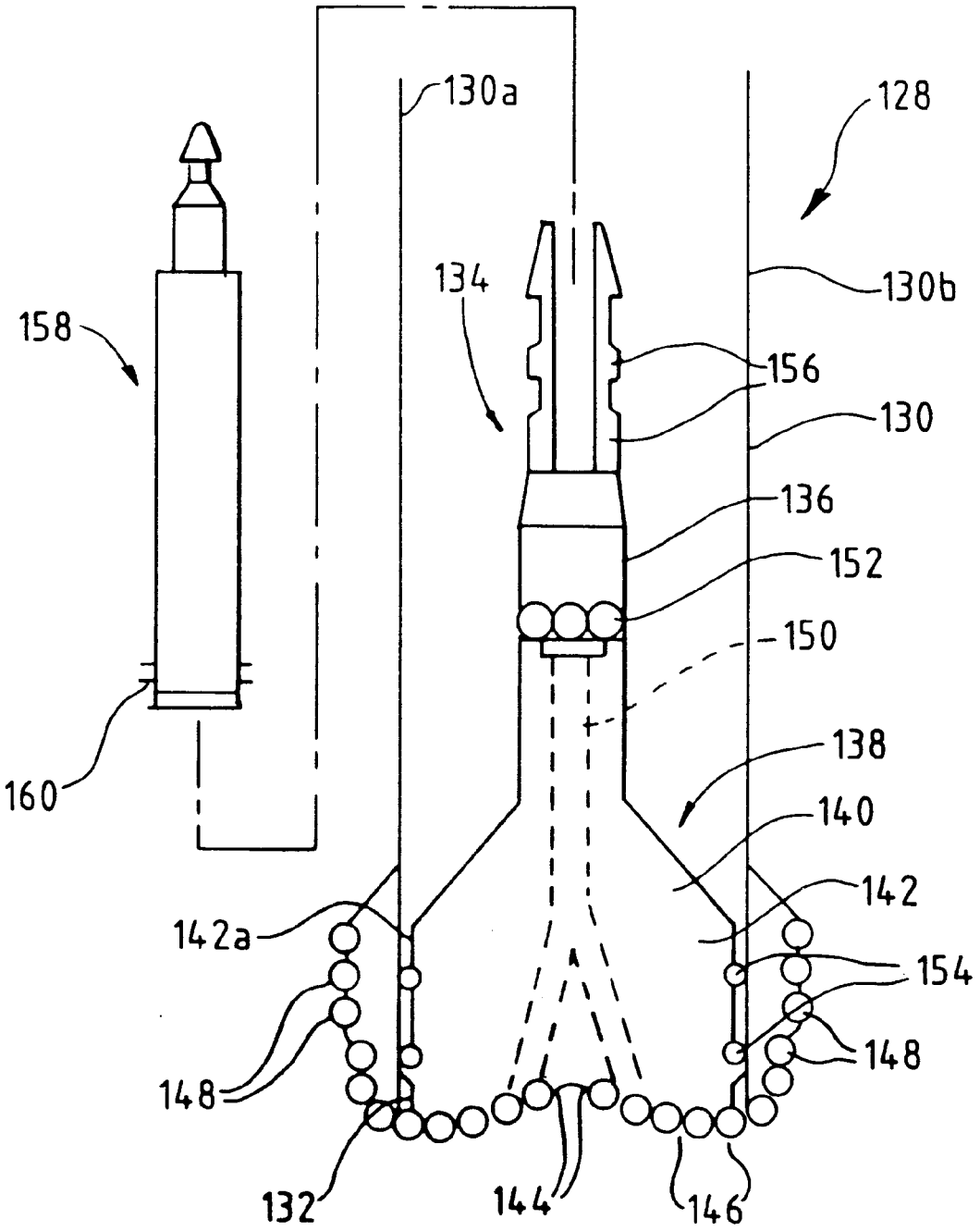
FIG. 14 is an elevational view of another alternative liner having an inner-retrievable bit body with primary cutters thereon and gauge cutters mounted around the outside of the liner assembly coaxially with the bit body and a spear retrieval tool for pulling the inner bit once drilling with the liner assembly is complete.

Another liner assembly 128 that can be used to drill into unstable or depleted formations such as formations 12 and 14 described herein is illustrated schematically in FIG. 14. The liner assembly 128 includes an annular liner wall 130 that has a landing shoulder 132 extending from the interior surface 130*a* of the wall radially inward. The landing shoulder 132 is adapted to carry a retrievable bit body 134 thereon. The bit body 134 has a relatively small diameter upper shank section 136 and a cutter carrying portion 138 below the shank 136. The cutter carrying portion 138 has a frusto-conical section 140 and an annular section 142 on the bottom of the frusto-conical section 140 with the annular section 142 having a diameter slightly less than the diameter across the liner wall surface 130*a*. The bottom of the annular section 142 has inclined surfaces 144 having primary cutting elements 146 mounted thereon for cutting the bore 24 to the diameter of the annular section outer surface 142*a*.

Gauge cutting elements 148 are mounted to the liner wall 130 at the bottom thereof around the liner wall outside surface 130*b* in fixed relation thereto coaxially about the bit body annular section 142. Accordingly, as the liner assembly 128 is rotated for drilling through the unstable or depleted formations 12 and 14, the gauge cutters 148 will cut the bore to a diameter larger than the diameter across the wall outer surface 130*b* so as to form an annular space having sufficient clearance between the liner wall surface 130*b* and the bore hole wall 24*b* to minimize tight hole and stuck pipe problems during drilling with the liner assembly 128. Similar to the other liner assemblies, the liner assembly 128 provides the advantage of controlling wellbore stability problems preventing caving of the bore walls 24*a* and allowing for a quick isolation between unstable or depleted formations 12 and 14, if necessary to keep fluid losses from becoming too high.

In order to keep the cutters 146 and 148 lubricated while washing away the cuttings from the cutters/rock interface, drilling mud 36 is pumped down into the liner 130. The drilling mud 36 is directed to the cutters 146 via passageway 150 formed in the bit body 134. For the mud to access the passageway 150, a plurality of radial entry ports 152 are formed in the shank portion 136. To isolate the flow of drilling mud 36 into the entry ports 152, O-rings seals 154 are mounted around the bit body annular section 142 so as to prevent mud from flowing between the outer annular surface 142*a* of the bit body annular section 142 and the inner wall surface 130*a* of the liner 130. In this manner, drilling mud 36 is properly flowed towards the juncture of the inclined surfaces 144 mounting the primary cutters 146 so as to properly reach these cutters and not flow around the annular section 142 on which they are mounted.

After drilling with the liner assembly 128, the bit 134 is removed from the wellbore 24 so that if subsequent drilling beyond the liner assembly 128 is desired, it can be accomplished through the liner 130 without having to drill through a shoe or a window as in the prior liner assemblies 10 and 108, respectively. The disadvantage of this is the time required to pull the bit 134 from the bore 24. To this end, the bit shank 136 is provided with raised annular flange sections 156 above the radial ports 152. A spear wireline retrieving tool 158 can be lowered into the liner 130 and onto the bit shank section 136 and dogs 160 can be activated to engage and grip the flange sections 156 so as to release the bit 134 from its carrying shoulder 132 and pull it from the bore 24 with the spear tool 158. Thereafter, drilling operations beyond the set liner assembly 128 can occur without any damage to the drill bit utilized in these subsequent drilling operations as by having to drill through portions 20 of the liner assembly.

While there have been illustrated and described particular embodiments of the present invention, it will be appreciated that numerous changes and modifications will occur to those skilled in the art, and it is intended in the appended claims to cover all those changes and modifications that fall within the true spirit and scope of the present invention.

What is claimed is:

1. A method of drilling into a reservoir formation that is unstable or depleted relative to adjacent formations, the method comprising the steps of:

drilling into an area above the unstable or depleted formation to form a wellbore in the area;

providing an elongate liner assembly having a portion thereof formed of a drillable material and cutters carried by the liner assembly disposed adjacent the bottom of the liner assembly;

running the liner assembly into the wellbore and rotating the liner assembly to drill through the area above the unstable or depleted formation and into an area in the unstable or depleted formation to extend the wellbore into the unstable or depleted formation with at least a section of the liner assembly in the unstable or depleted formation;

setting the liner assembly in the wellbore to secure the assembly therein with the cutters staying in the bore; and running a drill bit into the wellbore and rotating the drill bit to cut through the liner portion of drillable material with the drill bit for drilling beyond the set liner assembly.

2. The method of claim 1 wherein the drillable liner portion is a shoe of drillable material on the bottom of the liner assembly and having the cutters thereon, and further comprising the steps of:

providing mounting portions on the shoe for the cutters with the mounting portions including relief slots formed therein wherein the mounting portions are of a material that can be cut by the rotary drill bit; and releasing the cutters from the mounting portions by cutting through the shoe mounting portions and reliefs therein with the drill bit so as to minimize damaging contact of the drill bit with the cutters.

3. The method of claim 2 wherein the cutters on the liner shoe are rotated by rotating the liner assembly to perform rotary drilling operations therewith.

4. The method of claim 1 wherein the drillable liner portion is a window of material formed in the liner assembly that can be cut by the rotary drill bit, and further comprising the steps of:

providing a whipstock deflection plate that is secured in the liner assembly adjacent the window; and cutting through the window for drilling beyond the set liner assembly by engaging the rotating drill bit with the deflection plate and guiding the rotating drill bit to the window with the deflection plate where the bit cuts through the window to the formation exterior of the liner assembly.

5. The method of claim 4 wherein the liner assembly is filled with a drillable material around the whipstock deflection plate, and the cutters carried by the liner assembly are on a liner drill bit that is rotated by rotating the liner assembly to perform rotary drilling operations therewith.

6. The method of claim 1 wherein the unstable formation has a lower formation pressure relative to formations thereabove so that there is a differential pressure between the formations, and including sealing the overlying formation from the low pressure formation after running of the liner assembly and rotating of the cutters to limit formation and wellbore damage due to the differential pressure encountered when drilling from the overlying formation into the low pressure formation.

7. A liner assembly for drilling into an unstable formation, comprising:

a substantially elongate annular body, wherein the elongate body includes:

a liner portion having a bottom, and a shoe portion attached to the liner portion at the bottom thereof with the shoe portion having a cutter mounting portion thereof;

cutters carried on the cutter mounting portion;

a liner rotating mechanism for rotating the liner assembly to drill a wellbore into the unstable formation so that at least a section of the elongate body is disposed in the unstable formation after drilling with the cutters; and a drillable portion for being drilled out after the elongate body is set in the wellbore with the section of the body set in the unstable formation, the liner drillable portion including a shoe cutter mounting portion that is made of a drillable material, and relief spaces formed in the cutter mounting portion so that, when the material of the drillable cutter mounting portion is being drilled out by a drill bit, the cutters will release as the drill bit cuts through the mounting portion and reaches the relief spaces to minimize damaging contact of the drill bit with the cutters.

8. The liner assembly of claim 7 wherein the liner rotating mechanism includes a rotary drill string connected to the top of the elongate body to transmit rotation from the string to the elongate body for rotating the body and the cutters at the bottom thereof.

9. The liner assembly of claim 7 wherein the shoe has a bottom face with an outer periphery thereof having a predetermined diameter and the cutter mounting portion includes radial blades attached on the shoe bottom face extending generally radially outward towards the face outer periphery from inward locations on the face that are spaced from each other and having gauge cutters on the blades that are slightly beyond the shoe face periphery to form the bore in the unstable formation having a diameter greater than the shoe face predetermined diameter.

10. The liner assembly of claim 9 wherein the cutters are mounted on the blades at predetermined positions along the radial blades with the predetermined positions selected so that resultant forces from the cutting action of the cutters are directed towards a predetermined location along the periphery of the shoe to minimize shoe vibrations and stabilize the shoe during cutting.

11. The liner assembly of claim 10 wherein the blades and cutters are adapted for a bi-center cutting configuration.

12. The liner assembly of claim 9 wherein the shoe face has drilling fluid openings therein to allow drilling fluid to be circulated to the cutters and the blades have a predetermined thickness across the blades and a predetermined height from the shoe face with the number and size of the drilling fluid openings and the predetermined width and height of the blades being selected to optimize the rigidity and strength of the mounted cutters and the hydraulic flow of the circulating fluid to minimize pressure drops in the drilling fluid and balling of cut materials on the shoe.

13. A liner assembly for drilling into an unstable formation, comprising:

a liner having a substantially annular wall of a first predetermined diameter, having a central longitudinal axis, and having a bottom;

a shoe carried by the liner at the bottom of the annular wall and having a bottom face, wherein the shoe has:

a bottom face with an outer periphery thereof having a predetermined diameter, and a cutter mounting portion having radial blades attached on the shoe bottom face and extending generally radially outward towards the face outer periphery and from inward locations on the face that are spaced from each other, and gauge cutters on the blades that are carried slightly beyond the shoe face periphery to form a bore in the unstable formation having a diameter greater than the shoe face predetermined diameter;

sets of cutting elements mounted to the shoe and extending generally radially outward along the shoe, the sets of cutting elements including:

inner cutting elements that are spaced from each other on generally opposite sides of the longitudinal axis, and outer cutting elements that are mounted at positions beyond the liner wall predetermined diameter, the inner cutting elements mounted at a radially innermost position relative to the outer cutting elements, and the outer cutting elements mounted at a radially outermost position relative to the inner cutting elements; and a shoe rotating mechanism for rotating the shoe and the cutting elements carried thereon, wherein rotation of the shoe and the cutting elements drills a bore into the unstable formation having a second predetermined diameter that is greater than the first predetermined diameter so that, as the shoe advances downhole, the liner moves into the larger diameter bore to minimize bore damage into the unstable formation.

14. The liner assembly of claim 13 wherein the cutters and blades are adapted for a bi-center cutting configuration.

15. A liner assembly for drilling into an unstable formation, comprising:

a liner having a substantially annular wall of a first predetermined diameter, having a central longitudinal axis, and having a bottom;

a shoe carried by the liner at the bottom of the annular wall;

sets of cutting elements mounted to the shoe and extending generally radially outward along the shoe, wherein the cutting elements are mounted at predetermined positions and orientations relative to the longitudinal axis with the predetermined positions and orientations being selected so that resultant forces from the cutting action of the cutting elements are directed towards a predetermined location on the shoe to minimize shoe vibrations and stabilize the shoe during cutting, the sets of cutting elements including inner cutting elements that are spaced from each other on generally opposite sides of the longitudinal axis, and outer cutting elements that are mounted at a radially outermost position relative to the inner cutting elements, the inner cutting elements mounted at a radially innermost position relative to the outer cutting elements, and the outer cutting elements are mounted at positions beyond the liner wall predetermined diameter; and a shoe rotating mechanism for rotating the shoe and the cutting elements carried thereon, wherein rotation of the shoe and the cutting elements drills a bore into the unstable formation having a second predetermined diameter that is greater than the first predetermined diameter so that, as the shoe advances downhole, the liner moves into the larger diameter bore to minimize bore damage into the unstable formation.

16. The liner assembly of claim 15 wherein the cutters and blades are adapted for a bi-center cutting configuration.

17. A liner assembly for drilling into an unstable formation, comprising:

a liner having a substantially annular wall of a first predetermined diameter, having a central longitudinal axis, and having a bottom;

a shoe carried by the liner at the bottom of the annular wall;

sets of cutting elements mounted to the shoe and extending generally radially outward along the shoe, the sets of cutting elements including inner cutting elements that are spaced from each other on generally opposite sides of the longitudinal axis, and outer cutting elements, the inner cutting elements mounted at a radially innermost position relative to the outer cutting elements, and the outer cutting elements mounted at a radially outermost position relative to the inner cutting elements and at positions beyond the liner wall predetermined diameter;

radial blades attached to the shoe and having sections thereof distal from the shoe on which the cutting elements are mounted with the shoe and blades thereof being formed of a drillable material for being drilled out by a drill bit after the liner portion is set with at least a section thereof in the unstable formation, and a shoe rotating mechanism for rotating the shoe and the cutting elements carried thereon, wherein rotation of the shoe and the cutting elements drills a bore into the unstable formation having a second predetermined diameter that is greater than the first predetermined diameter so that, as the shoe advances downhole, the liner moves into the larger diameter bore to minimize bore damage into the unstable formation.

18. The liner assembly of claim 17 wherein the blades include relief slots extending between cutting elements thereon and opening to the distal surface of the blade mounting sections so that when the blades are being drilled out after setting of the liner portion the cutting elements will release as the drill bit cuts through the blades and reaches the relief slots to minimize damaging contact of the drill bit with the cutting elements.

19. A rotary liner assembly for drilling a bore hole into unstable formations, the rotary liner assembly comprising;

a substantially annular liner having a longitudinal axis for being rotated in the bore hole about its longitudinal axis;

a shoe including cutter mounting blades at the leading end of the liner aligned along the liner longitudinal axis for rotating therewith;

cutting elements mounted on the blades for engaging the formation and cutting therein as the liner and shoe are rotated; and reliefs in the blade arms for drilling of the blade arms by a drill bit after the rotary liner assembly has drilled into the unstable formation and at least a section of the liner is set therein to advance the bore hole beyond the liner with the drill bit cutting into the blade arm reliefs to release the cutting elements from the blade arms to minimize damaging contact of the drill bit with the cutting elements.

20. The rotary liner assembly of claim 19 wherein the blades include blades that extend generally radially on the shoe and include respective sets of cutting element; thereon with radially inner ends of the blades being spaced from the longitudinal axis to rotate eccentrically relative to the rotation of the liner and shoe about the longitudinal axis.

21. The rotary liner assembly of claim 19 wherein the cutting elements are mounted at predetermined positions and orientations relative to the longitudinal axis with the predetermined positions being selected so that the resultant forces from the cutting action of the cutting elements are directed towards a predetermined location on the shoe to minimize shoe vibrations and stabilize the shoe during cutting.

* * * * *

UNITED STATES PATENT AND TRADEMARK OFFICE

CERTIFICATE OF CORRECTION

PATENT NO. : 5,957,225

DATED : Sep. 28, 1999

INVENTOR(S) : Lawrence Allen Sinor

It is certified that error appears in the above-identified patent and that said Letters Patent is hereby corrected as shown below:

| Col. | Line | |
|---|---|---|
| 1 | 17 | "pumped clown through the drill"<br><br>should read:<br>"pumped down through the drill" |
| 1 | 51 | "production rates, Is the"<br><br>should read:<br>"production rates, as the" |
| 5 | 21 | "formation clue to differential"<br><br>should read:<br>"formation due to differential" |
| 17 | 29 | "with 5/8 inches,"<br><br>should read:<br>"with 9 5/8 inches," |

UNITED STATES PATENT AND TRADEMARK OFFICE

CERTIFICATE OF CORRECTION

PATENT NO. : 5,957,225 Page 2 of 2

DATED : Sep. 28, 1999

INVENTOR(S) : Lawrence Allen Sinor

It is certified that error appears in the above-identified patent and that said Letters Patent is hereby corrected as shown below:

| Col. | Line | |
|---|---|---|
| 22 | 18 | "assembly of claim 7"<br><br>should read:<br>"assembly of claim 9" |
| 24 | 55 | "cutting element; thereon"<br><br>should read:<br>"cutting elements thereon" |

Signed and Sealed this

Fifteenth Day of August, 2000

*Attest:*

Q. TODD DICKINSON

*Attesting Officer*

*Director of Patents and Trademarks*